US010573447B2

(12) United States Patent
Murashima et al.

(10) Patent No.: US 10,573,447 B2
(45) Date of Patent: Feb. 25, 2020

(54) THIN FILM MAGNET AND METHOD FOR MANUFACTURING THIN FILM MAGNET

(71) Applicant: Panasonic Intellectual Property Management Co., Ltd., Osaka (JP)

(72) Inventors: Yuji Murashima, Osaka (JP); Masanori Samejima, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 218 days.

(21) Appl. No.: 15/555,994

(22) PCT Filed: Mar. 14, 2016

(86) PCT No.: PCT/JP2016/001420
§ 371 (c)(1),
(2) Date: Sep. 6, 2017

(87) PCT Pub. No.: WO2016/157764
PCT Pub. Date: Oct. 6, 2016

(65) Prior Publication Data

US 2018/0061545 A1 Mar. 1, 2018

(30) Foreign Application Priority Data

Mar. 31, 2015 (JP) ..... 2015-073127
Mar. 31, 2015 (JP) ..... 2015-073247

(51) Int. Cl.
*H01F 10/12* (2006.01)
*H01F 10/30* (2006.01)
*H01F 41/18* (2006.01)

(52) U.S. Cl.
CPC ..... *H01F 10/12* (2013.01); *H01F 10/30* (2013.01); *H01F 41/18* (2013.01)

(58) Field of Classification Search
None
See application file for complete search history.

(56) References Cited

U.S. PATENT DOCUMENTS

2006/0198060 A1* 9/2006 Ishizone ..... B82Y 25/00 360/324.12
2006/0203396 A1* 9/2006 Ide ..... B82Y 25/00 360/324.1

(Continued)

FOREIGN PATENT DOCUMENTS

JP 2003-017320 1/2003
JP 2004-134416 4/2004

OTHER PUBLICATIONS

Chen et al. (J. Appl. Phys. 104, 093905-1 to 093905-4, 2008,) (Year: 2008).*

(Continued)

*Primary Examiner* — Kevin M Bernatz
(74) *Attorney, Agent, or Firm* — McDermott Will & Emery LLP

(57) ABSTRACT

A thin film magnet includes a substrate, an oxidation-inhibiting layer in an amorphous state disposed on an upper surface of the substrate, a first magnetic layer disposed on the oxidation-inhibiting layer, an intermediate layer disposed on the first magnetic layer, a second magnetic layer disposed on the intermediate layer, and a second oxidation-inhibiting layer in an amorphous state disposed above the second magnetic layer. The intermediate layer contains metal particles. The metal particles are diffused in the first magnetic layer and the second magnetic layer. The concentration of the metal particles in a part of the first magnetic layer decreases as the distance from the intermediate layer to the part of the first magnetic layer increases. The concentration of the metal particles in a part of the second magnetic (Continued)

layer decreases as the distance from the intermediate layer to the part of the second magnetic layer increases.

21 Claims, 24 Drawing Sheets

(56) References Cited

U.S. PATENT DOCUMENTS

2008/0236441 A1* 10/2008 Nobe ..... C25D 3/56
106/1.05
2012/0212859 A1* 8/2012 Tsuchiya ..... B82Y 10/00
360/294
2013/0182351 A1* 7/2013 Iwasaki ..... G11B 5/855
360/99.08
2016/0099017 A1* 4/2016 Hellwig ..... G11B 5/65
369/13.11
2019/0189917 A1* 6/2019 Honjo ..... H01L 21/8239

OTHER PUBLICATIONS

Nukaga et al. (IEEE Trans. Mag., 44(11), 2891-2894, 2008). (Year: 2008).*
Cheng et al. (J. Mag. Mag. Mat., 324, 3658-3661, 2012) (Year: 2012).*
Dong et al. (Corr. Sci., 77, 113-117, 2013) (Year: 2013).*
Qiu et al. (J. All. & Comp., 685, 459-464, 2016) (Year: 2016).*
Qiu et al. (J. All. & Comp., 733, 45-52, 2018). (Year: 2018).*
Shizhong An et al. (Scrip. Mat., 68, 432-435, 2013) (Year: 2013).*
Zhang et al. (J. Non-crys. Sol., 432, 361-365, 2016) (Year: 2016).*
Hong et al. (In Acta Mat., 2019, Abstract). (Year: 2019).*
Ohtake et al. (J. Crys. Grow., 2251-2254, 2009). (Year: 2009).*
International Search Report of PCT application No. PCT/JP2016/001420 dated Jun. 7, 2016.

* cited by examiner

FIG. 17

| Point | Co | Sm | Ta |
|---|---|---|---|
| A | 64.5 | – | 35.5 |
| B | 80.8 | 19.2 | – |
| C | 81.6 | 18.4 | – |
| D | 83.9 | 16.1 | – |
| E | 82.8 | 17.2 | – |
| F | 90.1 | 9.9 | – |
| G | 84.4 | 15.6 | – |
| H | 83.3 | 16.7 | – |
| I | 83.9 | 16.1 | – |
| J | 79.3 | 20.7 | – |
| K | 69.7 | – | 30.3 |

THIN FILM MAGNET AND METHOD FOR MANUFACTURING THIN FILM MAGNET

This application is a U.S. national stage application of the PCT international application No. PCT/JP2016/001420 filed on Mar. 14, 2016, which claims the benefit of foreign priority of Japanese patent application No. 2015-073247 filed on Mar. 31, 2015 and Japanese patent application No. 2015-073127 filed on Mar. 31, 2015, the contents all of which are incorporated herein by reference.

TECHNICAL FIELD

The present invention relates to a thin film magnet manufactured by a thin-film process and a method for manufacturing a thin film magnet.

BACKGROUND ART

Thin film magnets have been used as permanent magnets for use in equipment, such as sensors, actuators, and motors, in recent years. In a thin film magnet, a magnetic layer containing magnetic particles is formed on a substrate. A known magnetic layer contains samarium cobalt (SmCo), which is one of rare-earth element (R)-cobalt (Co) compounds, as a magnetic layer (see, for example, PTL 1).

In another known thin film magnet, layers containing Ta in order to reduce oxidation of a magnetic layer are disposed on both surface of the magnetic material to sandwich the magnetic layer (see, for example, PTL 2).

CITATION LIST

Patent Literature

PTL 1: Japanese Patent Laid-Open Publication No. 2004-134416

PTL 2: Japanese Patent Laid-Open Publication No. 2003-17320

SUMMARY

A thin film magnet includes a substrate, an oxidation-inhibiting layer in an amorphous state disposed on an upper surface of the substrate, a first magnetic layer disposed on the oxidation-inhibiting layer, an intermediate layer disposed on the first magnetic layer, a second magnetic layer disposed on the intermediate layer, and a second oxidation-inhibiting layer in an amorphous state disposed above the second magnetic layer. The intermediate layer contains metal particles. The metal particles are diffused in the first magnetic layer and the second magnetic layer. The concentration of the metal particles in a part of the first magnetic layer decreases as a distance from the intermediate layer to the part of the first magnetic layer increases. The concentration of the metal particles in a part of the second magnetic layer decreases as a distance from the intermediate layer to the part of the second magnetic layer increases.

BRIEF DESCRIPTION OF DRAWINGS

FIG. 17 is a table showing composition of the thin film magnet illustrated in FIG. 16.

DETAIL DESCRIPTION OF PREFERRED EMBODIMENTS

Figure 1A:
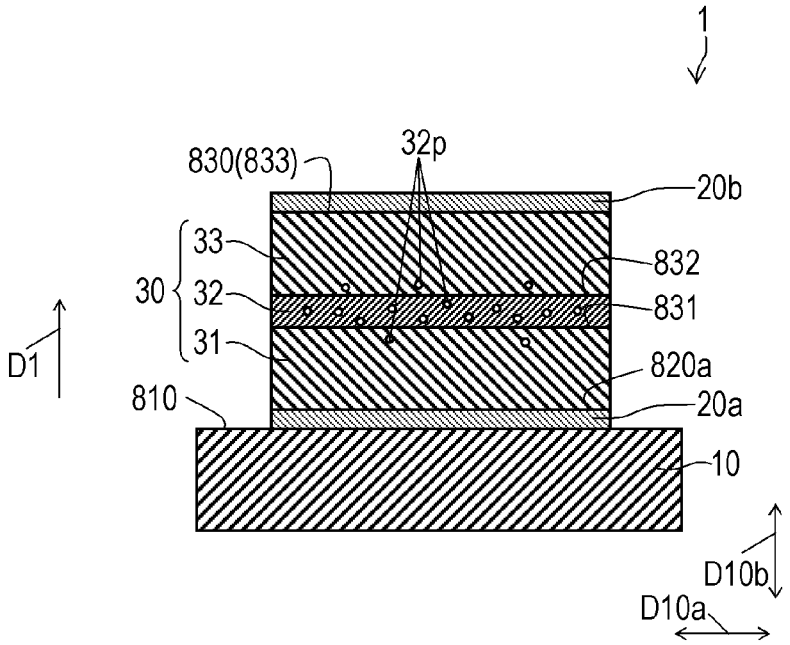
FIG. 1A is a cross-sectional view of a thin film magnet according to Exemplary Embodiment 1.

Permanent magnets for use in equipment such as sensors, actuators and motors are required to have high energy products. Recent magnets are used for various purposes and required to have various properties in accordance with purposes. For example, equipment such as sensors and actuators need to generate strong magnetic field in specific directions, and thus, a required thin film magnet has anisotropy in a specific direction such as an in-plane direction or a normal direction, a sufficiently large coercive force, and a high residual flux density (residual magnetization as magnet performance).

As described above, a permanent magnet having a high energy product is required as a permanent magnet for use in equipment such as a sensor, an actuator or and a motor. Environments where such equipment is used have become more and more severe through years, and permanent magnets for use in the equipment are required to have high heat resistance and reliability.

In general, a neodymium magnet is known as a permanent magnet having a high energy product. The neodymium magnet, however, needs to be supplemented with dysprosium (Dy), which is a heavy metal whose reserves are small, in order to have high heat resistance, and therefore, is expensive. In view of this, permanent magnets except the neodymium magnet are also demanded.

For example, a permanent magnet using $Sm_xCo_y$, which is a rare-earth element (R)-cobalt (Co) material, has a relatively high energy product and a high heat resistance and is excellent in temperature characteristics and corrosion resistance. A permanent magnet having a high energy product can have its volume necessary for obtaining the same energy reduced, and electronic equipment or other devices using such a permanent magnet can also be reduced in size. In view of this, attention has been given on permanent magnets using $Sm_xCo_y$.

Characteristics of a permanent magnet include a residual flux density and a coercive force of a magnetic flux density (B)-magnetic field (H) characteristic. The residual flux density is related to the intensity of a magnetic force generated as a magnet. The coercive force is related to the difficulty in reversing magnetic poles of a magnet by an external magnetic field. In general, as a permanent magnet, it is preferable that the residual flux density and the coercive force are both high and a squareness of magnetization (J)-magnetic field (H) characteristics is high. A thin film magnet has been also developed from the viewpoint of increasing both the residual flux density and the coercive force.

Permanent magnets are used for various purposes and are required to have characteristic in accordance with the purposes. Permanent magnets for use in sensors or actuators are required to generate strong magnetic fields in specific directions. To meet such a request for magnets, there have been developed magnets not only having increased residual flux density and coercive force as required in techniques to data but also having characteristics in accordance with purposes.

Specifically, developed is a rare-earth element (R)-cobalt (Co) compound thin film magnet having a strong anisotropy in a predetermined crystal orientation of a crystal material constituting a magnet, that is, having a so-called strong magnetocrystalline anisotropy, showing a sufficiently large coercive force and a high residual flux density, and a square J-H curve showing a relationship between magnetization and a magnetic field.

A permanent magnet for use in, for example, a sensor or an actuator is required to have magnetization directions arranged in an arbitrary single direction or a plurality of specific directions, such as an X direction, a Y direction, and/or a Z direction. In view this, in the case of using the rare-earth element (R)-cobalt (Co) compound having high magnetocrystalline anisotropy described above, a so-called magnetizing process of arranging magnetization in arbitrary directions by using polycrystalline in which crystal orientation is isotropic in three dimensions can be employed. In this case, however, since crystal orientations showing strong magnetization are isotropically arranged in three dimensions, magnetization becomes weak in each desired axial direction, resulting in a failure in producing a necessary magnetic field. In view of this, a process of arranging crystal orientation in specific directions is effective, and with this process, material performance can be efficiently obtained. To obtain a thin film magnet showing strong magnetization in a plurality of arbitrary directions, however, it is necessary to form a buffer layer for reducing a lattice constant difference from a substrate material to control crystal orientation. In general, in the case of using the techniques described above, a technique of performing crystallization simultaneously with crystal growth of a thin film is employed, and thus, the crystal growth needs to be performed in a high-temperature atmosphere, resulting in an increase in cost due to an increase in facility cost and a decrease in throughput. In addition, it is difficult to form a thin film having magnetocrystalline anisotropy in different crystal orientation directions on the same substrate, and formation of such a thin film magnet takes a high cost.

Exemplary embodiments will be hereinafter described in detail with reference to the drawings. In the drawings, especially in cross-sectional views, to facilitate understanding of the structure, ratios between actual dimensions of a thin film magnet and dimensions in the drawings are different between the longitudinal direction and the transverse direction.

Each of the following exemplary embodiments is a specific example of the present disclosure. Numerical values, shapes, materials, components, positions in arrangement of the components, connection states, steps, the order of steps, and so forth are examples, and are not intended to limit the present disclosure. Components of the following exemplary embodiments not recited in an independent claim showing a generic concept will be described as optional components.

In the following exemplary embodiments, a crystal having a hexagonal close-packed structure will be simply referred to as a hexagonal crystal. A crystal having a face-centered cubic structure and a crystal having a body-centered cubic structure will be simply referred to a cubic crystal when these crystals do not need to be distinguished.

Exemplary Embodiment 1

1-1. Configuration of Thin Film Magnet

FIG. 1A is a cross-sectional view of thin film magnet 1 according to Exemplary Embodiment 1. Thin film magnet 1 basically includes substrate 10, oxidation-inhibiting layer 20*a*, oxidation-inhibiting layer 20*b*, and magnetic body 30 disposed between oxidation-inhibiting layers 20*a* and 20*b*. Oxidation-inhibiting layer 20*a* is disposed on upper surface 810 of substrate 10. Magnetic body 30 is disposed on upper surface 820*a* of oxidation-inhibiting layer 20*a*. Oxidation-inhibiting layer 20*b* is disposed on upper surface 830 of magnetic body 30. Substrate 10, oxidation-inhibiting layer 20*a*, magnetic body 30, and oxidation-inhibiting layer 20*b* are stacked in this order in stacking direction D1 perpendicular to upper surface 810 of substrate 10. Magnetic body 30 includes magnetic layer 31 disposed on upper surface 820*a* of oxidation-inhibiting layer 20*a*, intermediate layer 32 on upper surface 831 of magnetic layer 31, and magnetic layer 33 disposed on upper surface 832 of intermediate layer 32. Magnetic layer 31, intermediate layer 32, and magnetic layer 33 are stacked in this order in stacking direction D1. Upper surface 833 of magnetic layer 33 constitutes upper surface 830 of magnetic body 30. Each of oxidation-inhibiting layer 20*a*, magnetic body 30, and oxidation-inhibiting layer 20*b* in stacking direction D1 has a thickness of about 500 nm.

Substrate 10 is, for example, a Si substrate having a surface at which a thermal oxidation film of $SiO_2$ serving as an insulator is formed. Substrate 10 is not limited to the Si substrate and may be any substrate that can withstand heat treatment performed later. Substrate 10 may be, for example, a single crystalline substrate made of material, such as heat-resistant glass, a sapphire substrate, or a MgO substrate, a ceramic substrate mainly containing $Al_2O_3$, $ZrO_2$, or MgO, or a substrate including a ceramic substrate and a heat-resistant glass glaze formed on the ceramic substrate.

Each of oxidation-inhibiting layers 20*a* and 20*b* is constituted by, for example, an amorphous layer containing Ta, which is a high-melting-point metal. The metal contained in oxidation-inhibiting layers 20*a* and 20*b* is not necessarily Ta, by may be at least one of Ta, Nb, W, and Mo.

Each of magnetic layers 31 and 33 contains a rare-earth element (R). Specifically, the rare-earth element (R) is Sm. For example, magnetic layers 31 and 33 are constituted by $SmCo_5$ having a hexagonal crystal structure. Each of magnetic layers 31 and 33 has a thickness of about 250 nm in stacking direction D1. Magnetic layers 31 and 33 may be constituted by $Sm_2Co_{17}$ having a rhombohedral crystal structure, besides $SmCo_5$. In accordance with the embodiments, in cases where $SmCo_5$ and $Sm_2Co_{17}$ are not distinguished from each other, these materials are simply referred to as $Sm_xCo_y$ with positive numbers x and y.

Intermediate layer 32 contains metal particles 32*p* having a coercive force lower than that of magnetic layer 31 and exhibiting a residual magnetization larger than that of magnetic layer 31. In stacking direction D1, intermediate layer 32 is sufficiently thinner than any of magnetic layers 31 and 33 and has a thickness ranging, e.g. from about 1 nm to about 10 nm. Intermediate layer 32 is made of a material having a crystallization temperature lower than that of each of magnetic layers 31 and 33 in order to cause magnetic layers 31 and 33 to be in an amorphous state during formation of magnetic layer 33 subsequent to the formation of magnetic layer 31 and intermediate layer 32.

Intermediate layer 32 is constituted by, e.g. a layer containing metal particles 32*p* made of Co or Cu. Co constituting intermediate layer 32 has a face-centered cubic structure, i.e., a cubic crystal oriented in a (110) direction. Cu constituting intermediate layer 32 has a face-centered cubic structure, i.e., a cubic crystal oriented in a (111) direction.

In a case where intermediate layer 32 contains Co, magnetic layers 31 and 33 has a hexagonal crystal or a rhombohedral crystal oriented in a (11-20) direction of $Sm_xCo_y$ after crystallization. Thus, each of magnetic layers 31 and 33 has a structure in which a plane parallel to upper surface 810 of substrate 10 is oriented in parallel with a (11-20) plane of $Sm_xCo_y$ as a hexagonal crystal or a rhombohedral crystal. Magnetic layers 31 and 33 thus have magnetocrystalline anisotropy in in-plane direction D10*a* parallel to upper surface 810 of substrate 10. Metal particles 32*p* of Co are diffused in magnetic layers 31 and 33. The concentration of metal particles 32*p* of Co diffused in a part of each magnetic layer decreases as the distance from intermediate layer 32 to the part of the magnetic layer increases.

Figure 1B:
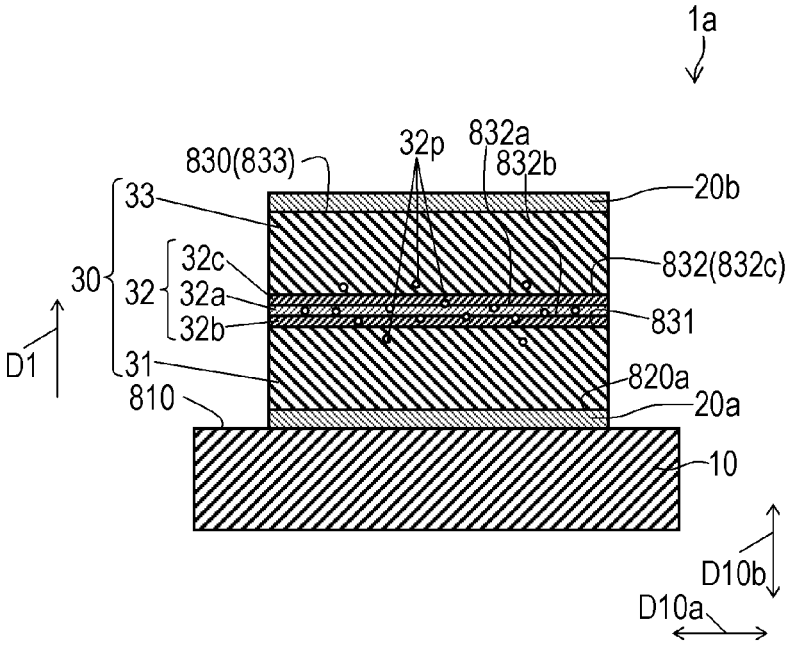
FIG. 1B is a cross-sectional view of another thin film magnet according to Embodiment 1.

FIG. 1B is a cross-sectional view of another thin film magnet 1*a* according to Embodiment 1. In FIG. 1B, components identical to those of thin film magnet 1 illustrated in FIG. 1A are denoted by the same reference numerals. Intermediate layer 32 of thin film magnet 1 illustrated in FIG. 1A is not limited to a single layer. Particularly in the case that intermediate layer 32 contains Co, intermediate layer 32 preferably includes at least three layers. In thin film magnet 1*a* illustrated in FIG. 1B, intermediate layer 32 includes three layers: lower layer 32*b*; center layer 32*a*; and upper layer 32*c*. Lower layer 32*b* is disposed on upper surface 831 of magnetic layer 31. Center layer 32*a* is disposed on upper surface 832*b* of lower layer 32*b*. Upper layer 32*c* is disposed on upper surface 832*a* of center layer 32*a*. Upper surface 832*c* of upper layer 32*c* constitutes upper surface 832 of intermediate layer 32. A main constituent of center layer 32*a* is Co that is also a constituent of magnetic layers 31 and 32. A main constituent of each of upper layer 32*b* and lower layer 32*c* is Cu. Each of upper layer 32*b* and lower layer 32*c* has a cubic crystal structure oriented in a (111) direction or a hexagonal crystal structure constituted by diffused Cu and a rare-earth element Sm and oriented in a (0001) direction. The reason why the main constituent of center layer 32*a* is Co is assumed to be because Cu atoms originally located in center layer 32*a* are replaced by part of Co atoms in magnetic layers 31 and 32 in a manufacturing process. Such a phenomenon also occurs when titanium (Ti) or zirconium (Zr) is used for intermediate layer 32.

Magnetocrystalline anisotropy of magnetic layers 31 and 32 is affected by the direction of crystal orientation in boundaries in intermediate layer 32 with magnetic layer 31 and magnetic layer 32. Thus, in the case where intermediate layer 32 is constituted by three layers, magnetocrystalline anisotropy of magnetic layer 31 is affected by the direction of crystal orientation of lower layer 32*b* while magnetocrystalline anisotropy of magnetic layer 32 is affected by the direction of crystal orientation of upper layer 32*c*.

In the following description of the present disclosure, a case where intermediate layer 32 is a single layer and a case where intermediate layer 32 is constituted by plural layers will not be distinguished. When the description is directed to the composition and crystal orientation of intermediate layer 32, attention is focused on the boundaries between intermediate layer 32 and each of magnetic layers 31 and 32.

Magnetization of thin film magnet 1 will be described below.

Figure 2:
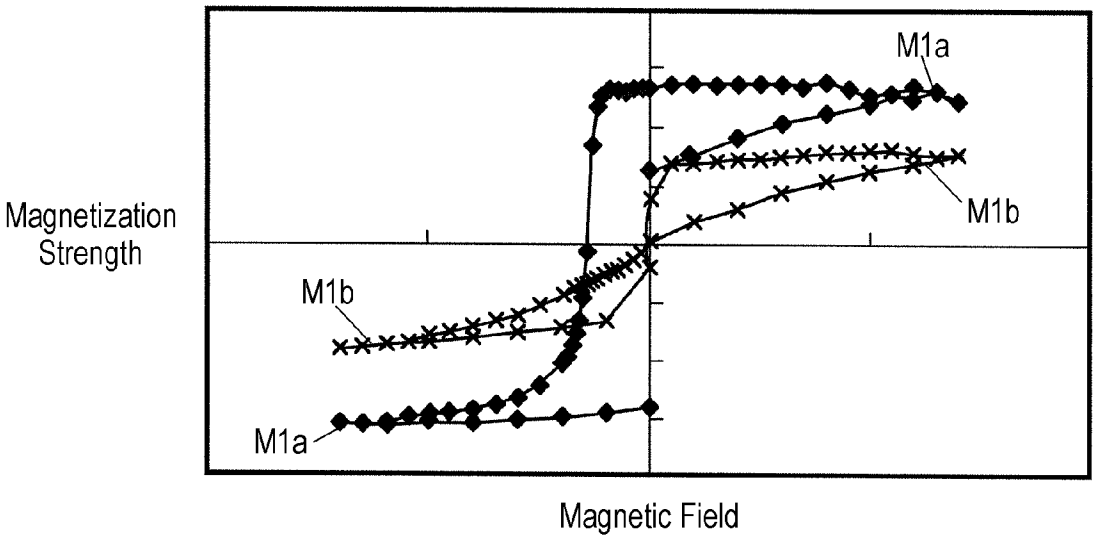
FIG. 2 shows magnetization curves of the thin film magnet illustrated in FIG. 1A including an intermediate layer containing Co.

FIG. 2 shows magnetization curves of thin film magnet 1 including intermediate layer 32 including metal particles 32*p* made of Co. In FIG. 2, the horizontal axis represents the intensity of a magnetic field, and the vertical axis represents the intensity of magnetization. FIG. 2 shows magnetization curve M1*a* of thin film magnet 1 in in-plane direction D10*a* and magnetization curve M1*b* of thin film magnet 1 in normal direction D10*b* (stacking direction D1) perpendicular to in-plane direction D10*a*.

As shown in FIG. 2, in the case that intermediate layer 32 contains Co, thin film magnet 1 exhibits greater magnetization in magnetization curve M1*a* in in-plane direction D10*a* than in magnetization curve M1*b* in stacking direction D1. Thus, the use of Co oriented in the (110) direction for intermediate layer 32 causes thin film magnet 1 to have magnetocrystalline anisotropy in in-plane direction D10*a* and to produce a strong magnetic field in in-plane direction D10*a*.

In a case where metal particles 32*p* of intermediate layer 32 is made of Cu, magnetic layer 31 and magnetic layer 33 are oriented in a (0001) direction of $Sm_xCo_y$ that is a hexagonal crystal or a rhombohedral crystal after crystallization. Thus, each of magnetic layer 31 and magnetic layer 33 has a structure in which a (0001) plane of $Sm_xCo_y$ as a hexagonal crystal or a rhombohedral crystal is parallel to surface 810 of substrate 10. Magnetic layers 31 and 33 thus have magnetocrystalline anisotropy in normal direction D10*b* perpendicular to surface 810 of substrate 10. Metal particles 32*p* made of Cu are dispersed in magnetic layers 31 and 33. The concentration of metal particles 32*p* made of Cu diffused in a part of magnetic layer 31 decreases as the distance from intermediate layer 32 to the part of magnetic layer 31 increases, and the concentration of metal particles in a part of magnetic layer 33 decreases as the distance from intermediate layer 32 to the part of magnetic layer 33 increases.

In the case that metal particles 32*p* made of Cu oriented in the (111) direction are dispersed in intermediate layer 32, in thin film magnet 1 after heat treatment, magnetic layers 31 and 33 have magnetocrystalline anisotropy in normal direction D10*b* and produce strong magnetic fields in normal direction D10*b*.

Figure 3:
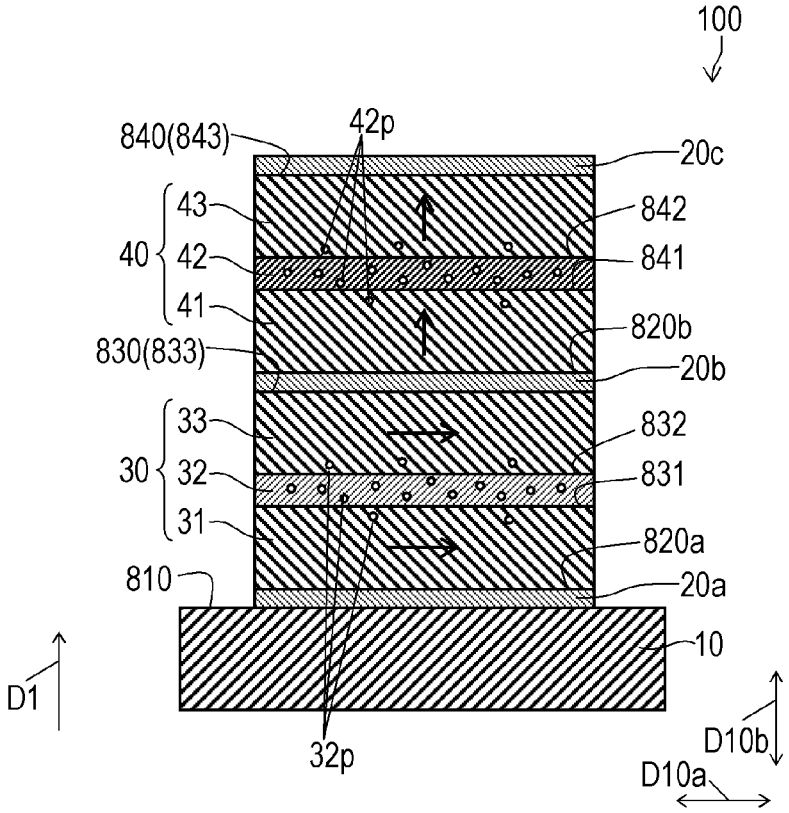
FIG. 3 is a cross-sectional view of the thin film magnet according to Embodiment 1.

A configuration of thin film magnet 100 according to Embodiment 1 will be described below. FIG. 3 is a cross-sectional view of thin film magnet 100 according to Embodiment 1. In FIG. 3, components identical to those of thin film magnet 1 illustrated in FIG. 1A are denoted by the same reference numerals.

Thin film magnet 100 has a structure in which plural magnetic bodies 30 each including magnetic layer 31, intermediate layer 32, and magnetic layer 33 of thin film magnet 1 described above are stacked on one another. More specifically, thin film magnet 100 has a structure in which magnetic body 40 having a structure of magnetic body 30 and oxidation-inhibiting layer 20*c* are further stacked on oxidation-inhibiting layer 20*b* of thin film magnet 1 described above.

Specifically, as illustrated in FIG. 3, thin film magnet 100 includes substrate 10, oxidation-inhibiting layer 20*a*, oxidation-inhibiting layer 20*b*, oxidation-inhibiting layer 20*c*, magnetic body 30 disposed between oxidation-inhibiting layers 20*a* and 20*b*, and magnetic body 40 disposed between oxidation-inhibiting layers 20*b* and 20*c*. More specifically, thin film magnet 100 includes substrate 10, oxidation-inhibiting layer 20*a* disposed on upper surface 810 of substrate 10, magnetic body 30 disposed on upper surface 820*a* of oxidation-inhibiting layer 20*a*, oxidation-inhibiting layer 20*b* disposed on upper surface 830 of magnetic body 30, magnetic body 40 disposed on upper surface 820*b* of oxidation-inhibiting layer 20*b*, and oxidation-inhibiting layer 20*c* disposed on upper surface 840 of magnetic body 40.

Oxidation-inhibiting layers 20*a*, 20*b*, and 20*c* are made of materials similar to one another.

Magnetic body 40 has a structure similar to that of magnetic body 30 of thin film magnet 1 described above, and includes magnetic layer 41 disposed on upper surface 820*b* of oxidation-inhibiting layer 20*b*, intermediate layer 42 disposed on upper surface 841 of magnetic layer 41, and magnetic layer 43 disposed on upper surface 842 of intermediate layer 42. Upper surface 843 of magnetic layer 43 constitutes upper surface 840 of magnetic body 40. Magnetic body 40 has a structure similar to that of magnetic body 30 of the basic structure of thin film magnet 1 described above. Magnetic layer 41, intermediate layer 42, and magnetic layer 43 correspond to magnetic layer 31, intermediate layer 32, and magnetic layer 33 of magnetic body 30, respectively, in the basic structure of thin film magnet 1 described above.

Oxidation-inhibiting layer 20*c* is disposed on upper surface 840 of magnetic body 40 (on upper surface 843 of magnetic layer 43).

Intermediate layer 32 contains metal particles 32*p* made of, e.g. Co. As described above, magnetic layers 31 and 33 are oriented in parallel with a (11-20) plane of $Sm_xCo_y$ as a hexagonal crystal or a rhombohedral crystal with respect to surface 810 of substrate 10. Thus, magnetic layers 31 and 33 have magnetocrystalline anisotropy in in-plane direction D10*a* parallel to surface 810 of substrate 10.

Intermediate layer 42 contains metal particles 42*p* made of, e.g. Cu. Magnetic layers 41 and 43 are oriented such that a (0001) plane of $Sm_xCo_y$ of a hexagonal crystal or a rhombohedral crystal is parallel to surface 810 of substrate 10. Thus, magnetic layers 41 and 43 have magnetocrystalline anisotropy in normal direction D10*b* perpendicular to surface 810 of substrate 10.

In accordance with Embodiment 1, $Sm_xCo_y$ is used as a specific example of a rare-earth element (R)-cobalt (Co) compound. Alternatively, Pr, Nd, Y, La, or Gd may be used as a rare-earth element.

1-2. Method for Manufacturing Thin Film Magnet

A method for manufacturing thin film magnet 100 according to the embodiment will be described below. FIGS. 4A to 4H are cross-sectional views of thin film magnet 100 for illustrating processes for manufacturing thin film magnet 100.

In the manufacturing of thin film magnet 100, first, substrate 10 is prepared. Substrate 10 may be, as described above, a Si substrate having a surface having a thermal oxidation film of $SiO_2$ serving as an insulator formed.

Figure 4A:
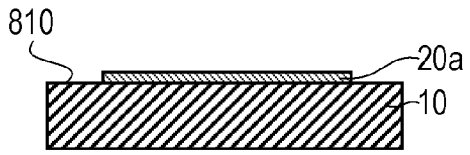
FIG. 4A is a cross-sectional view of the thin film magnet according to Embodiment 1 for illustrating a method for manufacturing the thin film magnet.

Next, as illustrated in FIG. 4A, oxidation-inhibiting layer 20*a* is formed on surface 810 of substrate 10 by a thin film formation technique. Oxidation-inhibiting layer 20*a* is formed by depositing Ta by sputtering. At this moment, oxidation-inhibiting layer 20*a* deposited on upper surface 810 of substrate 10 is in an amorphous state. Metal included in oxidation-inhibiting layers 20*a*, 20*b*, and 20*c* is not limited to Ta, and may be at least one of Ta, Nb, W, and Mo.

Figure 4B:
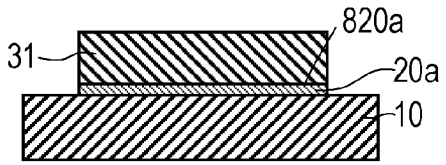
FIG. 4B is a cross-sectional view of the thin film magnet according to Embodiment 1 for illustrating the method for manufacturing the thin film magnet.

After that, as illustrated in FIG. 4B, magnetic layer 31 is formed on upper surface 820*a* of oxidation-inhibiting layer 20*a* by a thin film formation technique. Magnetic layer 31 is formed by depositing $Sm_xCo_y$ by sputtering. In the forming of magnetic layer 31, a surface temperature of upper surface 810 of substrate 10 is equal to or lower than 400° C. The reason for causing the surface temperature of substrate 10 to be equal to or lower than 400° C. is that magnetic layer 31 needs to be formed at a temperature lower than a crystallization temperature of $Sm_xCo_y$ in order to make magnetic layer 31 in an amorphous state.

The surface temperature of substrate 10 is determined based on a result obtained by previously measuring the temperature of another substrate having the same thermal capacity as substrate 10 with a thermocouple embedded in the substrate. The lower limit of the temperature of substrate 10 is determined in consideration of a reaction rate of sputtering and cooling capacity, and may be a room temperature. In the case of using a device having a cooling ability, the lower limit of the temperature of substrate 10 may be lower than room temperature.

The surface temperature of substrate 10 is thus determined to be lower than a crystallization temperature of $Sm_xCo_y$, and allows the crystal structure of magnetic layer 31 immediately after deposition of $Sm_xCo_y$ by sputtering to be in an amorphous state.

The deposition of $Sm_xCo_y$ may use an alloy having an adjusted composition. The alloy having an adjusted composition can be obtained by adjusting electric power ratio between a single Sm metal and a single Co metal and performing sputtering at the same time (co-sputtering). Alternatively, the alloy may have a super lattice structure subjected to composition control by adjusting a thickness ratio between a single Sm metal and a single Co metal. In the case of using the super lattice structure, a super lattice layer of a Sm metal layer and a Co metal layer in an amorphous state is formed while the thickness of the super lattice structure may be preferably equal to or smaller than 1 nm.

Figure 4C:
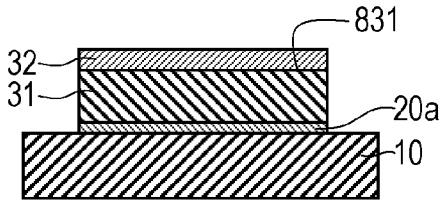
FIG. 4C is a cross-sectional view of the thin film magnet according to Embodiment 1 for illustrating the method for manufacturing the thin film magnet.

Subsequently, as illustrated in FIG. 4C, intermediate layer 32 is formed on upper surface 831 of magnetic layer 31 by a thin film formation technique. Intermediate layer 32 is formed by depositing Co by sputtering. Similarly to magnetic layer 31, in the forming of intermediate layer 32, the temperature of substrate 10 is equal to or lower than 400° C. This configuration can reduce crystallization of magnetic layer 31, and maintain magnetic layer 31 in an amorphous state. Metal particles 32*p* of Co in intermediate layer 32 are crystallized and oriented in the (110) direction. To crystallize metal particles 32*p* to allow Co to be oriented in the (110) direction, formation conditions of sputtering are controlled.

Figure 4D:
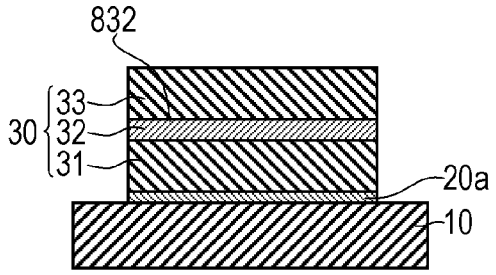
FIG. 4D is a cross-sectional view of the thin film magnet according to Embodiment 1 for illustrating the method for manufacturing the thin film magnet.

After that, as illustrated in FIG. 4D, magnetic layer 33 is deposited on upper surface 832 of intermediate layer 32 by a thin film formation technique. Magnetic layer 33 is formed by depositing $Sm_xCo_y$ by sputtering. Similarly to the formation of magnetic layer 31, in the forming of magnetic layer 33, the temperature of substrate 10 is equal to or lower than 400° C. This configuration allows the crystal structure of magnetic layer 33 immediately after deposition of $Sm_xCo_y$ by sputtering to be in an amorphous state.

The temperature in the forming of magnetic layer 31, intermediate layer 32, and magnetic layer 33 may be a room temperature, and the surface temperature of substrate 10 at the starting of formation of these layers may range from 16° C. to 25° C.

Figure 4E:
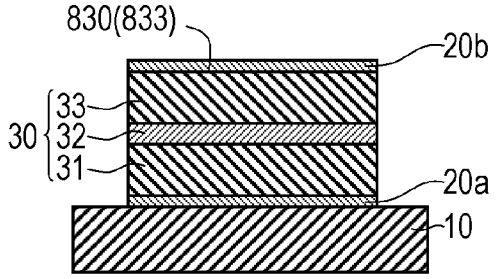
FIG. 4E is a cross-sectional view of the thin film magnet according to Embodiment 1 for illustrating the method for manufacturing the thin film magnet.

Then, as illustrated in FIG. 4E, oxidation-inhibiting layer 20*b* is formed on upper surface 833 of magnetic layer 33 by a thin film formation technique. Similarly to oxidation-inhibiting layer 20*a*, oxidation-inhibiting layer 20*b* is formed by depositing Ta by sputtering. At this moment, oxidation-inhibiting layer 20*b* deposited on magnetic layer 33 is in an amorphous state.

Figure 4F:
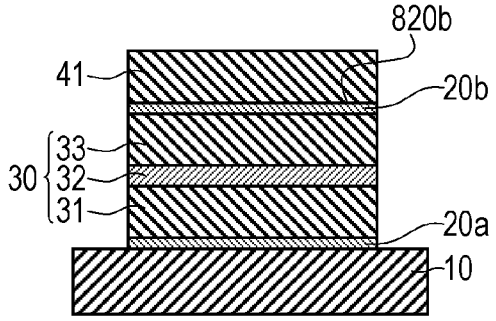
FIG. 4F is a cross-sectional view of the thin film magnet according to Embodiment 1 for illustrating the method for manufacturing the thin film magnet.

After that, as illustrated in FIG. 4F, magnetic layer 41 is formed on upper surface 820*b* of oxidation-inhibiting layer 20*b* by a thin film formation technique. Similarly to magnetic layer 31, magnetic layer 41 is formed by depositing $Sm_xCo_y$ by sputtering. In the forming of magnetic layer 41, the surface temperature of substrate 10 is equal to lower than 400° C. This configuration allows magnetic layer 41 to be formed in an amorphous state.

Figure 4G:
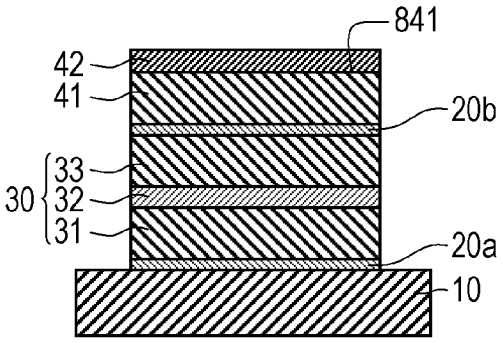
FIG. 4G is a cross-sectional view of the thin film magnet according to Embodiment 1 for illustrating the method for manufacturing the thin film magnet.

Subsequently, as illustrated in FIG. 4G, intermediate layer 42 is formed on upper surface 841 of magnetic layer 41 by a thin film formation technique. Intermediate layer 42 is formed by depositing Cu by sputtering. In the forming of intermediate layer 42, the temperature of substrate 10 is equal to or lower than 400° C. This manner can reduce crystallization of magnetic layer 41, and maintain magnetic layer 41 in an amorphous state. Metal particles 42*p* of Cu in intermediate layer 32 are crystallized and oriented in the (111) direction.

Figure 4H:
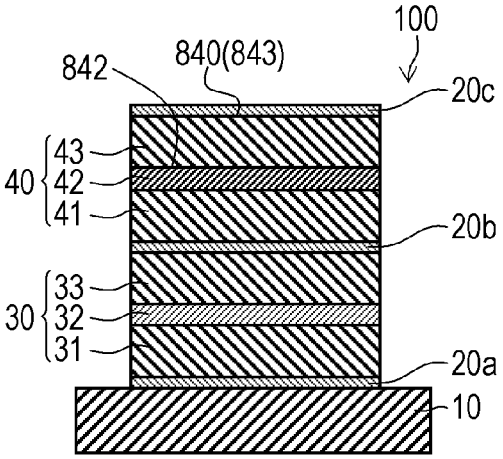
FIG. 4H is a cross-sectional view of the thin film magnet according to Embodiment 1 for illustrating the method for manufacturing the thin film magnet.

Then, as illustrated in FIG. 4H, magnetic layer 43 is formed on upper surface 842 of intermediate layer 42 by a thin film formation technique. Magnetic layer 43 is formed by depositing $Sm_xCo_y$ by sputtering. In the forming of magnetic layer 43, the temperature of substrate 10 is equal to or lower than 400° C. This configuration causes the crystal structure of magnetic layer 43 immediately after deposition of $Sm_xCo_y$ by sputtering to be in an amorphous state.

The temperature in the forming of magnetic layer 41, intermediate layer 42, and magnetic layer 43 may be a room temperature, and the surface temperature of substrate 10 at the starting of formation of these layers may range from 16° C. to 25° C.

Subsequently, oxidation-inhibiting layer 20*c* is formed on upper surface 843 of magnetic layer 43 by a thin film formation technique. Similarly to oxidation-inhibiting layer 20*b*, oxidation-inhibiting layer 20*c* is formed by depositing Ta by sputtering. At this moment, oxidation-inhibiting layer 20*c* deposited on magnetic layer 43 is in an amorphous state.

Next, substrate 10 including oxidation-inhibiting layer 20*a*, magnetic layer 31, intermediate layer 32, magnetic layer 33, oxidation-inhibiting layer 20*b*, magnetic layer 41, intermediate layer 42, magnetic layer 43, and oxidation-inhibiting layer 20*c* is crystallized by a heat treatment. The heat treatment is preferably performed in a vacuum atmosphere, a reduction atmosphere, or a non-oxidizing atmosphere. The vacuum atmosphere is preferably an ultrahigh vacuum or extremely high vacuum atmosphere from which residual oxygen and residual water are sufficiently removed. The reduction atmosphere is preferably an atmosphere to which hydrogen is introduced after evacuation to change the back pressure to an extremely high vacuum. The non-oxidizing atmosphere is preferably an atmosphere to which an argon (Ar) gas is introduced after exhausting to an extremely high vacuum.

The temperature at the heat treatment is determined such that the surface temperature of substrate 10 is equal to higher than 500° C. The upper limit of the temperature of the heat treatment on substrate 10 is not specifically limited, and may be in a range in which any magnetic layer 31 and magnetic layer 33 is not oxidized by, e.g. a $SO_2$ carrier gas supplied from the device and diffused into magnetic body 30. The heat treatment temperature is preferably lower than crystallization temperatures of oxidation-inhibiting layer 20*a*, oxidation-inhibiting layer 20*b*, and oxidation-inhibiting layer 20*c* in order to enable oxidation-inhibiting layer 20*a*, oxidation-inhibiting layer 20*b*, and oxidation-inhibiting layer 20*c* to maintain the amorphous state.

Crystallization by heat treatment may be performed in a vacuum while a surface temperature of substrate 10 is equal to or higher than 500° C. and equal to or lower than 700° C. The back pressure of the device before the start of heating may be equal to or lower than $10^{-4}$ Pa, and the pressure at the heating may be equal to or lower than $5\times10^{-4}$ Pa.

The temperature and vacuum conditions of substrate 10 in performing the heat treatment are not limited to these conditions, and may be an atmosphere that can reduce oxidation of magnetic layers 31 and 33 due to diffusion of a $SO_2$ carrier gas into magnetic body 30. For example, the degree of vacuum in the heat treatment may be equal to or lower than $10^{-3}$.

The heat treatment causes metal particles 32*p* of Co in intermediate layer 32 to be diffused to magnetic layers 31 and 33. Magnetic layers 31 and 33 are crystallized. In this crystallization, magnetic layers 31 and 33 are oriented in accordance with orientation of intermediate layer 32. As described above, in the case of using metal particles 32*p* of Co oriented in the (110) direction for intermediate layer 32, in thin film magnet 100 after the heat treatment, magnetic layers 31 and 33 are oriented such that the (11-20) plane of $Sm_xCo_y$ as a hexagonal crystal or a rhombohedral crystal is parallel to surface 810 of substrate 10. Thus, magnetic layers 31 and 33 have magnetocrystalline anisotropy in in-plane direction D10*a*. Since oxidation-inhibiting layers 20*a* and 20*b* are in an amorphous state in the heat treatment, magnetic layers 31 and 33 are oriented in in-plane direction D10*a* and crystallized using, as a start point of crystal growth, the interface between intermediate layer 32 and each of magnetic layers 31 and 33.

The heat treatment causes metal particles 42*p* of Cu in intermediate layer 42 to be diffused into magnetic layers 41 and 43. Magnetic layers 41 and 43 are crystallized. In this crystallization, magnetic layers 41 and 43 are oriented in accordance with orientation of intermediate layer 42. As described above, in the case of using metal particles 42*p* of Cu oriented in the (111) direction for intermediate layer 42, in thin film magnet 100 after the heat treatment, magnetic layers 41 and 43 are oriented such that the (0001) plane of $Sm_xCo_y$ as a hexagonal crystal or a rhombohedral crystal is parallel to surface 810 of substrate 10. Thus, magnetic layers 41 and 43 have magnetocrystalline anisotropy in normal direction D10*b*. Since oxidation-inhibiting layers 20*c* and 20*d* are in an amorphous state in the heat treatment, magnetic layers 41 and 43 are oriented in normal direction D10*b* and crystallized using, as a start point of crystal growth, the interface between intermediate layer 42 and each of magnetic layers 41 and 43.

The crystallization of intermediate layers 32 and 42 described above is performed simultaneously by the same heat treatment.

As described above, through the process of performing heat treatment, magnetic layer 31, intermediate layer 32, and magnetic layer 33 constitute magnetic body 30 while magnetic layer 41, intermediate layer 42, and magnetic layer 43 constitute magnetic body 40. Magnetic body 30 has magnetocrystalline anisotropy in in-plane direction D10*a* parallel to surface 810 of substrate 10 while magnetic body 40 has magnetocrystalline anisotropy in normal direction D10*b* perpendicular to surface 810 of substrate 10.

After that, magnetic bodies 30 and 40 are magnetized. As a method for magnetization, a magnetic field is applied to magnetic bodies 30 and 40 so that magnetic fluxes penetrate magnetic bodies 30 and 40 in the direction of magnetization.

In general, a magnetic field necessary for magnetic saturation in the direction of an axis of hard magnetization of a magnetic material is sufficiently larger than that in the direction of an axis of easy magnetization. Thus, a magnetic field necessary for magnetic saturation in the hard axis direction (normal direction D10*b*) of magnetic body 30 having in-plane magnetic anisotropy, for example, is sufficiently larger than a magnetic field necessary for magnetic saturation in the easy axis direction (normal direction D10*b*) of magnetic body 40 having normal magnetic anisotropy. A magnetic field necessary for magnetic saturation in the hard axis direction (in-plane direction D10*a*) of magnetic body 40 is sufficiently larger than a magnetic field necessary for magnetic saturation in the easy axis direction (in-plane direction D10*a*) of magnetic body 30. Thus, coercive forces of magnetic body 30 and magnetic body 40 in the direction of axis of easy magnetization are compared so that magnetization is first performed on one of the magnetic bodies having a larger coercive force and then on the other, in the direction of the easy axis. In a case where a coercive force of magnetic body 30 in the easy axis direction (in-plane direction D10*a*) is equal to a coercive force of magnetic body 40 in the easy axis direction (normal direction D10*b*), a magnetic field necessary for saturation is larger in magnetic body 40 under the influence of a demagnetizing field, and thus, magnetization is first performed on magnetic body 40.

The manufacturing method described above allows magnetic body 30 to generate a magnetic field in in-plane direction D10*a*, and allows magnetic body 40 to generate a magnetic field in normal direction D10*b*.

The order of strengths of magnetic fields necessary for magnetic saturation is reversed from the order described above between in-plane direction D10*a* and normal direction D10*b* depending on various conditions, such as a composition ratio of Sm and Co, crystal orientation, particle size, an additive, and a combination of these conditions. In the case that the order is reversed, the order of performing magnetization may be reversed.

In accordance with the embodiment, the heat treatment and the magnetization are performed separately, but may be performed simultaneously.

1-3. Advantages and Others

As described above, in thin film magnet 100 according to Embodiment 1, $Sm_xCo_y$ having a high energy product is used for magnetic layers 31, 33, 41, and 43. Co and Cu are contained in intermediate layer 32 and intermediate layer 42, respectively. This configuration allows thin film magnet 100 to have magnetocrystalline anisotropy in in-plane direction D10*a* and normal direction D10*b*, and have a high energy product, a sufficiently large coercive force, and a high residual flux density. In addition, since magnetic bodies 30 and 40 exhibiting different orientations are stacked, magnetic bodies 30 and 40 having magnetic anisotropy in in-plane direction D10*a* and normal direction D10*b* are formed simultaneously in thin film magnet 100.

The c axes of crystalline particles of magnetic body 30, that is, axes in the (0001) direction of $Sm_xCo_y$, are generally oriented in in-plane direction D10*a*. However, magnetic body 30 according to Embodiment 1 has a polycrystal structure and includes crystalline dispersion, and thus, it is not intended that the c axes of all the crystalline particles are completely oriented in the same direction in a plane. For example, in the case that Co is used in the intermediate layer, magnetic body 30 has magnetocrystalline anisotropy in in-plane direction D10*a*. This, however, means that the c axes of crystalline particles of magnetic body 30 are generally oriented in in-plane direction D10*a* and does not mean that the c axes of all the crystalline particles are completely oriented in in-plane direction D10*a*. In magnetic body 30 in accordance with Embodiment 1, the c axes are oriented in in-plane direction D10*a* as a whole. As long as the number of crystalline particles having c axes at angles ranging from 0° to 45° with respect to in-plane direction D10*a* is larger than the number of crystalline particles having c axes at angles ranging from 45° to 90° with respect to in-plane direction D10*a*, similar advantages can be obtained although the degree of the advantages is different.

Regarding magnetocrystalline anisotropy in in-plane direction D10*a*, in accordance with Embodiment 1, magnetocrystalline anisotropy isotropically appears in in-plane direction D10*a* in magnetic body 30. In this manner, on the same substrate 10, thin film magnets having large coercive forces in arbitrary directions of in-plane direction D10*a* and normal direction D10*b* can be formed simultaneously. Magnetization can be caused in an arbitrary direction in in-plane direction D10*a*.

Since in-plane magnetic anisotropy in in-plane direction D10*a* is isotropic, magnetization may be performed such that magnetic fields are generated in two different directions from each other by about 90° in in-plane direction D10*a*. This configuration provides thin film magnet 100 capable of efficiently generating magnetic fields in three directions of, for example, the X direction, the Y direction, and the Z direction at once on the same substrate 10.

In accordance with Embodiment 1, magnetic layers 31, 33, 41, and 43 are made of $Sm_xCo_y$, but may not be made of $Sm_xCo_y$. For example, part of Co may be replaced by Cu and Fe to enhance magnetization and a coercive force as a material. To increase the effect of replacement between Co and other elements, Zr or other elements may be mixed as an additive. In magnetic layers 31, 33, 41, and 43, Co of $Sm_xCo_y$ may be replaced by Fe so that $Sm_2Fe_{17}N_3$ containing N, which is an interstitial material, is obtained. $Sm_2Fe_{17}N_3$ is a rhombohedral crystal. In this case, magnetic layers 31, 33, 41, and 43 may be produced in an atmosphere subjected to nitrogen replacement in crystallization to cause nitrogen to enter. A material containing a nitride material may be used for magnetic layers 31, 33, 41, and 43 and intermediate layer 32.

In this case, since Sm—Fe—N is discomposed at a temperature equal to or higher than 650° C., magnetic layers 31, 33, 41, and 43 are preferably crystallized at a temperature equal to or lower than 600° C.

Specifically, an amorphous SmFeN layer may be formed above substrate 10 by performing a low-temperature sputtering on a SmFeN target in a mixed atmosphere of Ar gas and $N_2$ gas. Alternatively, an amorphous SmFeN may be formed above substrate 10 by performing a low-temperature sputtering on a SmFe target in mixed atmosphere of Ar gas and $N_2$ gas.

After that, the back pressure of the SmFeN layer formed above substrate 10 is evacuated to a vacuum atmosphere or an extremely high vacuum, and then, is subjected to a heat treatment in high-purity nitrogen at a pressure adjusted to be reduced. This configuration crystallizes SmFeN.

In accordance with Embodiment 1 described above, magnetic body 30 has magnetocrystalline anisotropy in in-plane direction D10*a* while magnetic body 40 has magnetocrystalline anisotropy in normal direction D10*b*. Alternatively, magnetocrystalline anisotropy of magnetic body 30 may appear in normal direction D10*b* while magnetocrystalline anisotropy of magnetic body 40 may appear in in-plane direction D10*a*. More specifically, intermediate layer 32 may be constituted by Cu oriented in the (111) direction while intermediate layer 42 may be constituted by Co oriented in the (110) direction.

Instead of Co, intermediate layer 32 described above may contain Fe that is a cubic crystal having a (110) plane oriented in parallel with surface 810 of substrate 10. Similarly, instead of Co, CoFe that is a cubic crystal having a (110) plane oriented in parallel with surface 810 of substrate 10 may be used. In intermediate layer 42, Cu may be replaced by Ni having a (111) plane with crystalline orientation. In intermediate layer 32, Cu may be replaced by metal particles 32*p* of a hexagonal crystal having a (0001) plane with crystalline orientation. In metal particles 32*p* of this hexagonal crystal, Ti, Co, Zr, Mg, or Hf may be used. In particular, Ti is preferable because of a small amount of lattice mismatch. Co as a hexagonal crystal can be obtained by controlling conditions of sputtering. Materials constituting intermediate layers 32 and 42 may be replaced with each other.

Each of oxidation-inhibiting layers 20*a*, 20*b*, and 20*c* may contain Nb, W, or Mo, instead of Ta. Oxidation-inhibiting layers 20*a*, 20*b*, and 20*c* are preferably made of non-magnetic materials and have high melting points. In particular, each of oxidation-inhibiting layers 20*a*, 20*b*, and 20*c* preferably has a melting point equal to or higher than three times as high as the heat treatment temperature at which $SmCo_5$ films of magnetic layers 31, 33, 41, and 43 are crystallized. This configuration can effectively reduce recrystallization of oxidation-inhibiting layers 20*a*, 20*b*, 20*c* in the crystallizing of magnetic layers 31, 33, 41, and 43. Each of oxidation-inhibiting layers 20*a*, 20*b*, and 20*c* contain at least one of Ta, Nb, W, and Mo.

Oxidation-inhibiting layer 20*a*, oxidation-inhibiting layer 20*b*, and oxidation-inhibiting layer 20*c* do not need to be made of the same material, but are made of the same material in this exemplary embodiment from the viewpoint of reduction of materials to be used.

Intermediate layers 32 and 42 may not necessarily be continuous in in-plane direction D10*a* of substrate 10, and may have partially island shapes or be interrupted. In this cases raise no problems in function. That is, in accordance with Embodiment 1, the "intermediate layer" includes any layer disposed between magnetic layers including not only a case where the intermediate layer is continuous in in-plane direction D10*a* of substrate 10 but also a case where the intermediate layer has partially an island shape or be interrupted.

The presence of intermediate layers 32 and 42 may be detected by a method of performing observation with a transmission electron microscope. In addition to the observation with a transmission electron microscope, a method of measuring the concentrations of metal particles 32*p* and 42*p* constituting intermediate layers 32 and 42 and determining, as intermediate layers 32 and 42, regions where the distribution concentrations of metal particles 32*p* and 42*p* are locally high.

It was confirmed that similar advantages can be obtained when the thickness of each of intermediate layers 32 and 42 in stacking direction D1 changes within a range from 1 nm to 30 nm. The observation with a scanning-type transmission electron microscope confirmed a structure in which intermediate layer 32 spreads into magnetic layers 31 and 33 to have partially island shapes in magnetic body 30. Thus, it can be concluded that the same advantages can be obtained when the thicknesses changes, as described above.

Modification of Exemplary Embodiment 1

Figure 5:
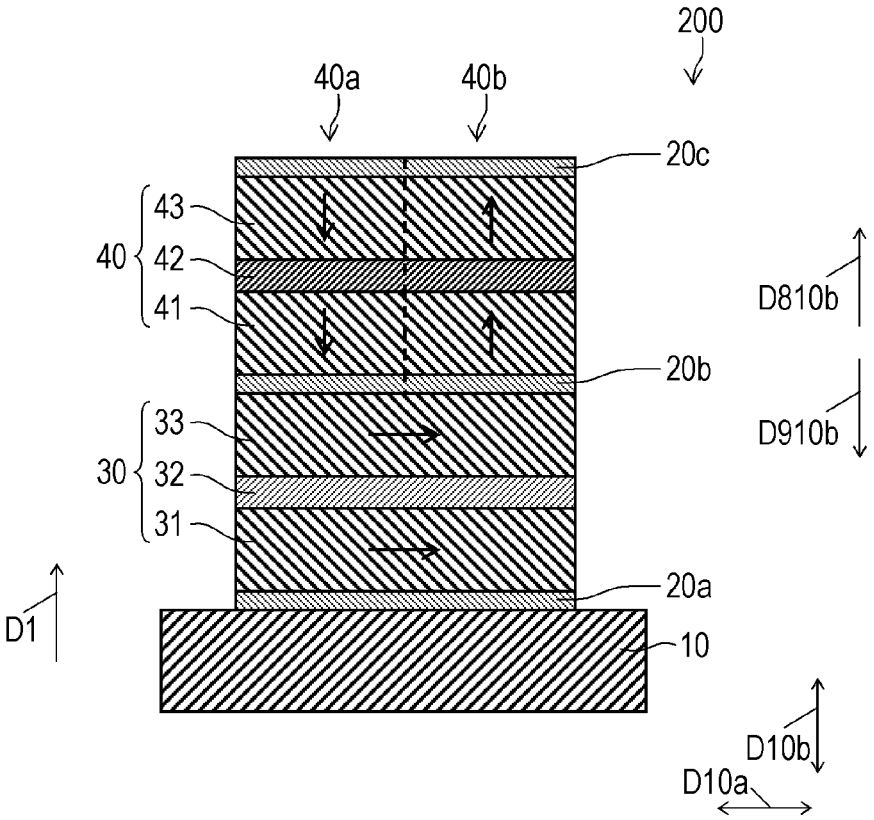
FIG. 5 is a cross-sectional view of still another thin film magnet according Embodiment 1.

A modification of Embodiment 1 will be described below. FIG. 5 is a cross-sectional view of still another thin film magnet 200 according Embodiment 1. In FIG. 5, components identical to those of thin film magnet 100 illustrated in FIG. 3 are denoted by the same reference numerals.

As illustrated in FIG. 5, similarly to thin film magnet 100, in thin film magnet 200, magnetic body 30 has magnetocrystalline anisotropy in in-plane direction D10*a*, and magnetic body 40 has magnetocrystalline anisotropy in normal direction D10*b*.

In thin film magnet 100 illustrated in FIG. 3, magnetic body 40 is magnetized in a single direction parallel to normal direction D10*b*. In thin film magnet 200 illustrated in FIG. 5, magnetic body 40 includes region 40*b* magnetized in upward direction D810*b* parallel to normal direction D10*b* and region 40*a* magnetized in downward direction D910*b* parallel to normal direction D10*b*.

More specifically, in thin film magnet 200, as illustrated in FIG. 5, magnetic body 40 includes region 40*a* magnetized in downward direction D910*b* parallel to normal direction D10*b*, that is, magnetized in the direction from oxidation-inhibiting layer 20*c* to oxidation-inhibiting layer 20*b*, and region 40*b* magnetized in upward direction D810*b* parallel to normal direction D10*b*, that is, in the direction from oxidation-inhibiting layer 20*b* to oxidation-inhibiting layer 20*c*.

In general, in a thin film magnet having magnetocrystalline anisotropy in the normal direction, a demagnetizing field inversely proportional to the thickness of the thin film is generated in the thickness direction, and thus, the intensity of magnetization significantly depends on the thickness of the thin film That is, as the thickness decreases, the intensity of magnetization of the thin film magnet decreases. This may cause degradation of performance, such as a decrease in the density of magnetic fluxes generated from magnetic body 40 to the outside or a flux reversal in a magnetic field opposite to the magnetization direction.

In thin film magnet 200, since the directions of magnetization of regions 40*a* and 40*b* of magnetic body 40 in normal direction D10*b* is opposite to each other, a magnetic flux that has penetrated region 40*a* in downward direction D910*b* parallel to normal direction D10*b* penetrates magnetic body 30 having magnetocrystalline anisotropy in in-plane direction D10*a*, and further penetrates region 40*b* in upward direction D810*b* parallel to normal direction D10*b*. Thus, the magnetic path length in which magnetic fluxes pass increases and the influence of a demagnetizing field decreases so that magnetization increases. Accordingly, in thin film magnet 200, magnetization in normal direction D10*b* increases, stabilizing the direction of magnetization in magnetic body 40. In a configuration including a soft magnetic layer instead of magnetic body 30, stability of the direction of magnetization in magnetic body 40 can be obtained, but in heat treatment, degradation of surface properties of the soft magnetic layer, alloying due to interdiffusion, or degradation of magnetic properties due to particle growth, occurs. On the other hand, thin film magnet 200 described above does not raise such problems.

As an example, in magnetic body 40, the thickness of each of magnetic layers 41 and 43 in stacking direction D1 (normal direction D10*b*) is about 250 nm while the thickness of intermediate layer 42 in stacking direction D1 (normal direction D10*b*) ranges from about 5 nm to about 100 nm. The width of each of regions 40*a* and 40*b* in in-plane direction D10*a* is, e.g. about several micrometers.

Exemplary Embodiment 2

2-1. Method for Manufacturing Thin Film Magnet

Figure 6:
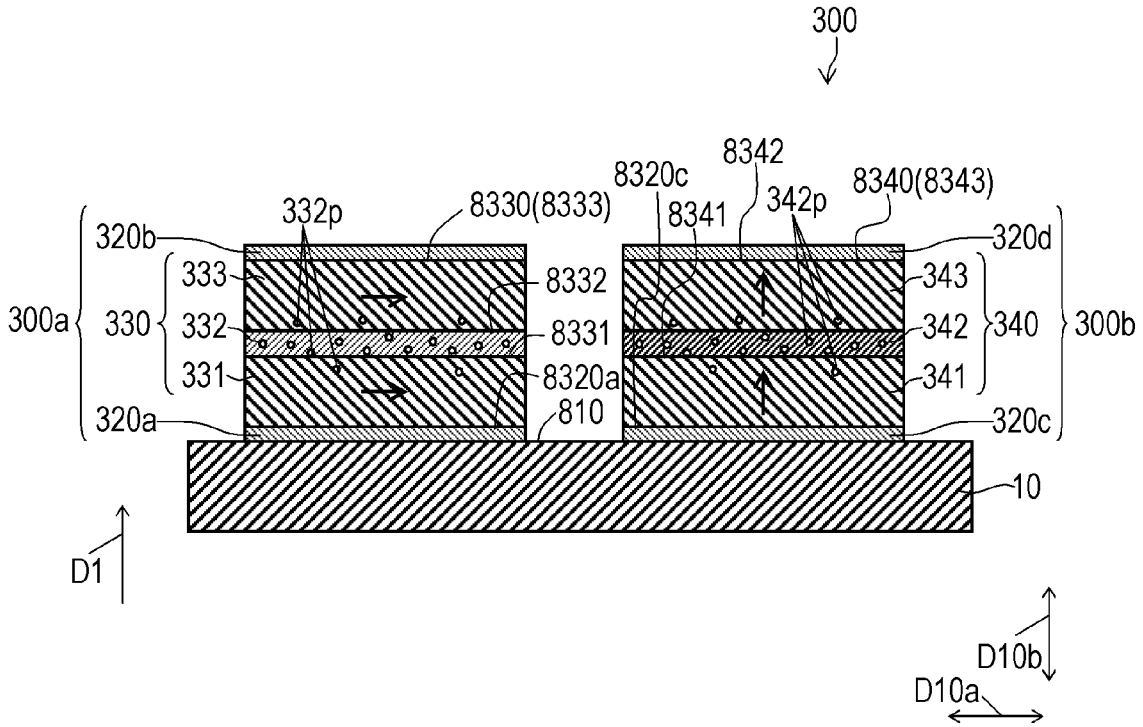
FIG. 6 is a cross-sectional view of a thin film magnet according to Exemplary Embodiment 2.

FIG. 6 is a cross-sectional view of thin film magnet 300 according to Exemplary Embodiment 2. In FIG. 6, components identical to those of thin film magnet 100 according to Embodiment 1 illustrated in FIG. 3 are denoted by the same reference numerals.

In thin film magnet 100 according to Embodiment 1 illustrated in FIG. 3, magnetic body 40 is stacked above magnetic body 30. In thin film magnet 300 according to Embodiment 2 illustrated in FIG. 6, magnetic bodies 330 and 340 are provided on the same upper surface 810 of substrate 10.

As illustrated in FIG. 6, in thin film magnet 300 according to Embodiment 2, thin film magnet 300*a* having magnetocrystalline anisotropy in in-plane direction D10*a* and thin film magnet 300*b* having magnetocrystalline anisotropy in normal direction D10*b* are provided on upper surface 810 of one substrate 10.

Thin film magnet 300*a* includes oxidation-inhibiting layer 320*a* provided on upper surface 810 of substrate 10, magnetic body 330 provided on upper surface 8320*a* of oxidation-inhibiting layer 320*a*, and oxidation-inhibiting layer 320*b* provided on upper surface 8330 of magnetic body 330. Substrate 10, oxidation-inhibiting layer 320*a*, magnetic body 330, and oxidation-inhibiting layer 320*b* are stacked on one another in this order in stacking direction D1. Magnetic body 330 includes magnetic layer 331 provided on upper surface 8320*a* of oxidation-inhibiting layer 320*a*, intermediate layer 332 provided on upper surface 8331 of magnetic layer 331, and magnetic layer 333 provided on upper surface 8332 of intermediate layer 332. Magnetic layer 331, intermediate layer 332, and magnetic layer 333 are stacked on one another in this order in stacking direction D1. Upper surface 8333 of magnetic layer 333 constitutes upper surface 8330 of magnetic body 330. Magnetic layer 330 has magnetocrystalline anisotropy in in-plane direction D10*a*.

Intermediate layer 332 includes metal particles 332*p* having a coercive force lower than that of magnetic layer 331 and exhibiting residual magnetization higher than that of magnetic layer 331. Metal particles 332*p* are diffused in magnetic layers 331 and 333. The concentration of diffused metal particles 332*p* at a part of magnetic layer 331 decreases as the distance from intermediate layer 332 to the part of magnetic layer 331 increases. The concentration of diffused metal particles 332*p* at a part of magnetic layer 333 decreases as the distance from intermediate layer 332 to the part of magnetic layer 333 increases Thin film magnet 300*b* includes oxidation-inhibiting layer 320*c* provided on upper surface 810 of substrate 10, magnetic body 340 provided on upper surface 8320*c* of oxidation-inhibiting layer 320*c*, and oxidation-inhibiting layer 320*d* provided on upper surface 8340 of magnetic body 340. Substrate 10, oxidation-inhibiting layer 320*c*, magnetic body 340, and oxidation-inhibiting layer 320*d* are stacked on one another in this order in stacking direction D1. Magnetic body 340 includes magnetic layer 341 provided on upper surface 8320*c* of oxidation-inhibiting layer 320*c*, intermediate layer 342 provided on upper surface 8341 of magnetic layer 341, and magnetic layer 343 provided on upper surface 8342 of intermediate layer 342. Magnetic layer 341, intermediate layer 342, and magnetic layer 343 are stacked on one another in this order in stacking direction D1. Upper surface 8343 of magnetic layer 343 constitutes upper surface 8340 of magnetic body 340. Magnetic layer 340 has magnetocrystalline anisotropy in normal direction D10*b*.

Intermediate layer 342 includes metal particles 342*p* having a coercive force lower than that of magnetic layer 341 and showing residual magnetization higher than that of magnetic layer 341. Metal particles 342*p* are diffused in magnetic layers 341 and 343. The concentration of diffused metal particles 342*p* at a part of magnetic layer 341 decreases as the distance from intermediate layer 342 to the part of magnetic layer 341 increases. The concentration of diffused metal particles 342*p* at a part of magnetic layer 343 decreases as the distance from intermediate layer 342 to the part of magnetic layer 343 increases.

In such a configuration, magnetic body 330 and magnetic body 340 exhibiting different orientations are formed in the same plane by a single manufacturing process so that thin film magnet 300 having magnetocrystalline anisotropy in in-plane direction D10*a* and normal direction D10*b* can be provided at once.

2-2. Method for Manufacturing Thin Film Magnet

A method for manufacturing thin film magnet 300 will be described below. FIGS. 7A to 7J are cross-sectional views of thin film magnet 300 for illustrating processes for manufacturing thin film magnet 300.

In manufacturing of thin film magnet 300, substrate 10 is first prepared similarly to the manufacturing of thin film magnet 100 according to Embodiment 1. Substrate 10 is a Si substrate, having a surface having a thermal oxidation film of $SiO_2$ serving as an insulator formed at the surface, as described above.

Figure 7A:
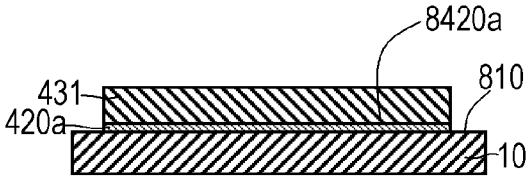
FIG. 7A is a cross-sectional view of the thin film magnet according to Embodiment 2 for illustrating a method for manufacturing the thin film magnet according to Embodiment 2.

Next, as illustrated in FIG. 7A, oxidation-inhibiting layer 420*a* constituting oxidation-inhibiting layers 320*a* and 320*c* is formed on surface 810 of substrate 10 by a thin film formation technique. Oxidation-inhibiting layers 320*a* and 320*c* are formed simultaneously to one unit as oxidation-inhibiting layer 420*a* by using the same material by the same process.

Oxidation-inhibiting layer 420*a* is formed by depositing Ta by sputtering. At this moment, oxidation-inhibiting layer 420*a* deposited on upper surface 810 of substrate 10 is in an amorphous state. The metal contained in each of oxidation-inhibiting layer 320*a* (420*a*), oxidation-inhibiting layer 320*b*, oxidation-inhibiting layer 320*c* (420*a*), and oxidation-inhibiting layer 320*d* is not limited to Ta, and may include at least one of Ta, Nb, W, and Mo.

Subsequently, magnetic layer 431 constituting magnetic layers 331 and 341 is formed on upper surface 8420*a* of oxidation-inhibiting layer 420*a* by a thin film formation technique. Magnetic layers 331 and 341 are formed simultaneously at once as magnetic layer 431 with the same material by the same process.

Magnetic layer 431 is formed by depositing $Sm_xCo_y$ by sputtering. In the forming of magnetic layer 431, the surface temperature of substrate 10 is equal to or lower than 400° C. to maintain magnetic layer 431 in an amorphous state.

The deposition of $Sm_xCo_y$ may employ an alloy having an adjusted composition, an alloy having a composition obtained by adjusting electric power ratio between a single Sm metal and a single Co metal and performing sputtering at the same time (co-sputtering), or an alloy having a super lattice structure subjected to composition control by adjusting a thickness ratio between a single Sm metal and a single Co metal. In the case of employing the super lattice structure, a super lattice layer of a Sm metal layer and a Co metal layer in an amorphous state is formed, and has preferably a super lattice structure equal to or less than 1 nm.

Figure 7B:
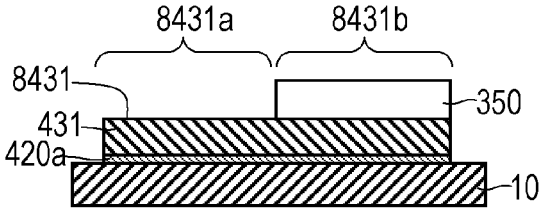
FIG. 7B is a cross-sectional view of the thin film magnet according to Embodiment 2 for illustrating the method for manufacturing the thin film magnet according to Embodiment 2.
Figure 7C:
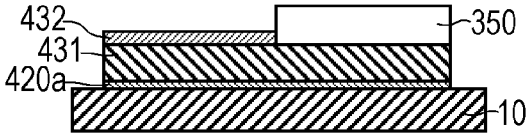
FIG. 7C is a cross-sectional view of the thin film magnet according to Embodiment 2 for illustrating the method for manufacturing the thin film magnet according to Embodiment 2.

Next, as illustrated in FIG. 7B, metal mask 350 is disposed on portion 8431*b* of upper surface 8431 of magnetic layer 431 in a region where thin film magnet 300*b* is to be formed. After that, as illustrated in FIG. 7C, intermediate layer 432 constituting intermediate layer 332 is formed by a thin film formation technique on portion 8431*a* of upper surface 8431 of magnetic layer 431 where metal mask 350 is not disposed. Intermediate layer 432 is formed by depositing Co by sputtering.

Similarly to the formation of magnetic layer 431, in the forming of intermediate layer 432, the temperature of substrate 10 is equal to or lower than 400° C. This configuration reduces crystallization of magnetic layer 431, and maintain magnetic layer 431 in an amorphous state. Formation at a lower temperature can minimize the influence of decrease in pattern accuracy caused by a shift of the mask due to the difference in thermal expansion between materials constituting metal mask 350 and substrate 10 at a high temperature or a temperature warp of metal mask 350. Co constituting intermediate layer 432 is crystallized and oriented in the (110) direction.

Figure 7D:
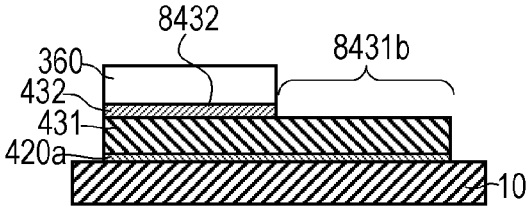
FIG. 7D is a cross-sectional view of the thin film magnet according to Embodiment 2 for illustrating the method for manufacturing the thin film magnet according to Embodiment 2.
Figure 7E:
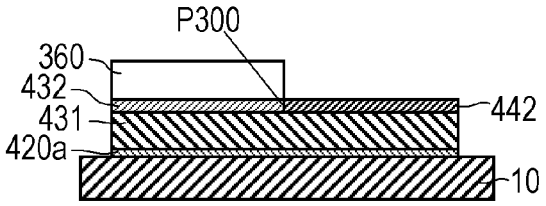
FIG. 7E is a cross-sectional view of the thin film magnet according to Embodiment 2 for illustrating the method for manufacturing the thin film magnet according to Embodiment 2.

Subsequently, as illustrated in FIG. 7D, metal mask 350 is removed, and then, metal mask 360 is disposed on upper surface 8432 of intermediate layer 432 that is a region where thin film magnet 300*a* is to be formed. After that, as illustrated in FIG. 7E, intermediate layer 442 constituting intermediate layer 342 is formed by a thin film formation technique on portion 8431*b* of upper surface 8431 of magnetic layer 431 on which metal mask 360 is not disposed. Intermediate layer 442 is formed by depositing Cu by sputtering. In this figure, intermediate layers 432 and 442 adjoin each other at boundary portion P300, but may be apart from each other or partially overlap each other at boundary portion P300.

Similarly to the formation of magnetic layer 431, in the forming of intermediate layer 442, the temperature of substrate 10 is equal to or lower than 400° C. This configuration reduces crystallization of magnetic layer 431, and maintain magnetic layer 431 in an amorphous state. Formation at a lower temperature can minimize the influence of a shift of the mask due to the difference in thermal expansion between metal mask 360 and substrate 10. Cu constituting intermediate layer 442 is crystallized and oriented in the (111) direction.

Figure 7F:
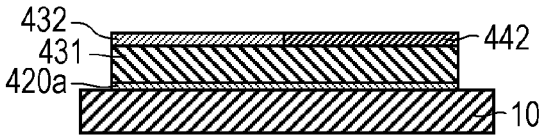
FIG. 7F is a cross-sectional view of the thin film magnet according to Embodiment 2 for illustrating the method for manufacturing the thin film magnet according to Embodiment 2.
Figure 7G:
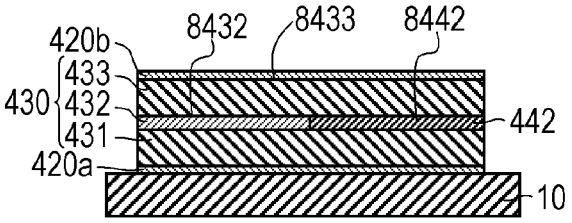
FIG. 7G is a cross-sectional view of the thin film magnet according to Embodiment 2 for illustrating the method for manufacturing the thin film magnet according to Embodiment 2.

Next, as illustrated in FIG. 7F, metal mask 360 is removed. Subsequently, as illustrated in FIG. 7G, magnetic layer 433 constituting magnetic layers 333 and 343 is formed by a thin film formation technique on upper surface 8432 of intermediate layer 432 and upper surface 8442 of intermediate layer 442. Magnetic layers 333 and 343 are formed simultaneously at once as magnetic layer 433 with the same material by the same process.

Magnetic layer 433 is formed by depositing $Sm_xCo_y$ by sputtering. Similarly to the formation of magnetic layer 431, in the forming of magnetic layer 433, the temperature of substrate 10 is equal to or lower than 400° C. This configuration maintains the crystal structure of magnetic layer 333 in an amorphous state.

As an example, the temperature in the forming of magnetic layer 431, intermediate layer 432, and magnetic layer 433 may be a room temperature, and the surface temperature of substrate 10 in the starting of the formation of these layers may range from 16° C. to 25° C.

After that, as illustrated in FIG. 7G, oxidation-inhibiting layer 420*b* constituting oxidation-inhibiting layers 320*b* and 320*d* is formed on upper surface 8433 of magnetic layer 433 by a thin film formation technique. Oxidation-inhibiting layers 320*b* and 320*d* are thus formed simultaneously at once as oxidation-inhibiting layer 420*b* with the same material by the same process.

Similarly to oxidation-inhibiting layer 420*a*, oxidation-inhibiting layer 420*b* is formed by depositing Ta by sputtering. At this moment, oxidation-inhibiting layer 420*b* deposited on upper surface 8433 of magnetic layer 433 is in an amorphous state.

Figure 7H:
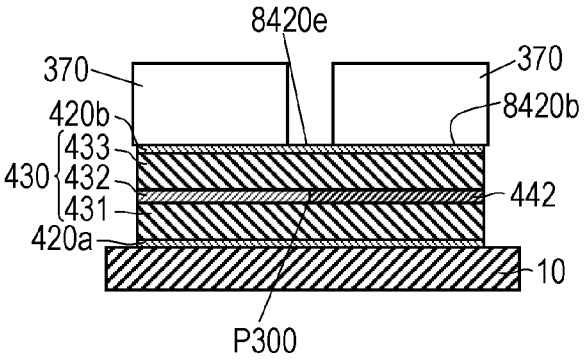
FIG. 7H is a cross-sectional view of the thin film magnet according to Embodiment 2 for illustrating the method for manufacturing the thin film magnet according to Embodiment 2.

Subsequently, as illustrated in FIG. 7H, resist 370 is disposed on upper surface 8420*b* of oxidation-inhibiting layer 420*b*. Resist 370 is disposed on a region which does not include boundary portion P300 between intermediate layer 432 and intermediate layer 442, that is, on upper surface 8420*b* of oxidation-inhibiting layer 420*b* in a region where thin film magnet 300*a* and thin film magnet 300*b* are finally formed. Portion 8420*e* of upper surface 8420*b* of oxidation-inhibiting layer 420*b* is exposed from resist 370.

Figure 7I:
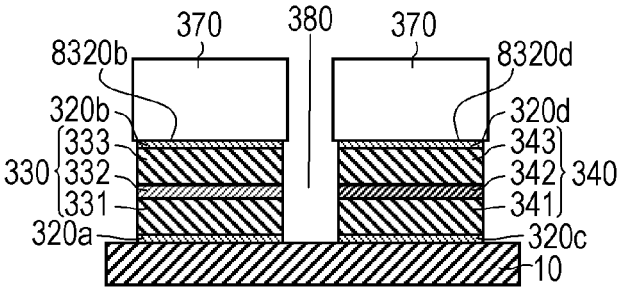
FIG. 7I is a cross-sectional view of the thin film magnet according to Embodiment 2 for illustrating the method for manufacturing the thin film magnet according to Embodiment 2.

Then, as illustrated in FIG. 7I, in a region where resist 370 is not disposed, that is, in portion 8420*e* of upper surface 8420*b* of oxidation-inhibiting layer 420*b* exposed from resist 370, hole 380 is formed by etching oxidation-inhibiting layer 420*a*, magnetic layer 431, intermediate layer 432, intermediate layer 442, magnetic layer 433, and oxidation-inhibiting layer 420*b*, including boundary portion P300 between intermediate layer 432 and intermediate layer 442, to reach upper surface 810 of substrate 10. Hole 380 divides oxidation-inhibiting layer 420*a* into oxidation-inhibiting layers 320*a* and 320*c*, divides magnetic layer 431 into magnetic layers 331 and 341, separates intermediate layers 432 and 442 from each other to become intermediate layers 332 and 342, respectively, divides magnetic layer 433 into magnetic layers 333 and 343, and divides oxidation-inhibiting layer 420*b* into oxidation-inhibiting layers 320*b* and 320*d*. This configuration separates film magnet 300*a* including oxidation-inhibiting layer 320*a*, magnetic layer 331, intermediate layer 332, magnetic layer 333, and oxidation-inhibiting layer 320*b* from thin film magnet 300*b* including oxidation-inhibiting layer 320*b*, magnetic layer 341, intermediate layer 342, magnetic layer 343, and oxidation-inhibiting layer 320*d*. The etching employed here may be wet etching, or dry etching such as reactive ion etching or ion milling.

Figure 7J:
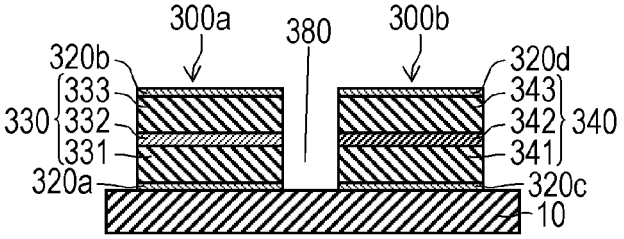
FIG. 7J is a cross-sectional view of the thin film magnet according to Embodiment 2 for illustrating the method for manufacturing the thin film magnet according to Embodiment 2.

After that, as illustrated in FIG. 7J, resist 370 is removed from upper surfaces 8320*b* and 8320*d* of oxidation-inhibiting layers 320*b* and 320*d* by using a resist remover or by ashing. Thin film magnet 300*a* thus has a configuration in which oxidation-inhibiting layer 320*a*, magnetic layer 331, intermediate layer 332, magnetic layer 333, and oxidation-inhibiting layer 20*b* are stacked on substrate 10. Thin film magnet 300*b* thus has a configuration in which oxidation-inhibiting layer 320*c*, magnetic layer 341, intermediate layer 342, magnetic layer 343, and oxidation-inhibiting layer 320*d* are stacked on substrate 10.

After that, substrate 10 having thin film magnets 300*a* and 300*b* provided thereon is crystallized by heat treatment. Conditions for the heat treatment are similar to those for thin film magnet 100 according to Embodiment 1, and their detailed description will not be repeated.

In the above description, resist 370 employs a photosensitive organic resist, but may employ an inorganic material obtained by patterning an inorganic material, such as a non-magnetic metal material or an oxide material, by mask evaporation or other techniques as a substitute for the resist. This material can preferably eliminate the process of removing the resist after patterning, and allow thin film formation, patterning, and heat treatment to proceed without breaking a vacuum atmosphere so that oxidation of side surfaces of magnets 330 and 340 exposed to hole 380 is suppressed.

As a metal material as the non-magnetic material, Ta or W, or $SiO_2$ as an oxide of the non-magnetic material may be used. These materials are selected in consideration of selectivity in etching as a subsequent process. The same material as oxidation-inhibiting layers 320*b* and 320*d* may be used as a metal material of the non-magnetic material. In this case, however, each of oxidation-inhibiting layers 320*b* and 320*d* has a thickness large enough to allow layers 320*b* and 320*d* to function as oxidation-inhibiting layers after the etching.

The heat treatment diffuses metal particles of Co constituting intermediate layer 332 into magnetic layers 331 and 333. Magnetic layers 331 and 333 are crystallized. In this crystallization, the magnetic layers 331 and 333 are oriented in accordance with orientation of intermediate layer 332. As described above, in the case of using Co oriented in the (110) direction for intermediate layer 332, in thin film magnet 100 after the heat treatment, magnetic layers 331 and 333 are oriented such that the (11-20) plane of $Sm_xCo_y$ as a hexagonal crystal or a rhombohedral crystal is parallel to the substrate surface of substrate 10. Thus, magnetic layers 331 and 333 have magnetocrystalline anisotropy in in-plane direction.

The heat treatment causes the metal particles of Cu constituting intermediate layer 342 to be diffused into magnetic layers 341 and 343. Magnetic layers 341 and 343 are crystallized. In this crystallization, the magnetic layers 341 and 343 are oriented in accordance with orientation of intermediate layer 342. As described above, in the case of using Cu oriented in the (111) direction for intermediate layer 342, in thin film magnet 100 after the heat treatment, magnetic layers 341 and 343 are oriented such that the (0001) plane of $Sm_xCo_y$ as a hexagonal crystal or a rhombohedral crystal is parallel to the substrate surface of substrate 10. Thus, magnetic layer 341 and magnetic layer 343 have magnetocrystalline anisotropy in the normal direction.

As described above, the heat treatment allows magnetic layer 331 formed below intermediate layer 332, intermediate layer 332, magnetic layer 333 formed above intermediate layer 332 to constitute magnetic body 330, and allows magnetic layer 341 formed below intermediate layer 342, intermediate layer 342, magnetic layer 343 formed above intermediate layer 342 to constitute magnetic body 340. Magnetic body 330 has magnetocrystalline anisotropy in in-plane direction D10*a* parallel to surface 810 of substrate 10 while magnetic body 340 has magnetocrystalline anisotropy in normal direction D10*b* perpendicular to surface 810 of substrate 10.

After that, magnetic bodies 330 and 340 are magnetized. As a method for magnetization, a magnetic field is applied to magnetic bodies 330 and 340 so that magnetic fluxes penetrate magnetic bodies 330 and 340 in the direction of magnetization.

In general, a magnetic field necessary for magnetic saturation in an axis direction in which magnetization of a magnetic material is difficult is much larger than that in an axis direction in which magnetization is easy. Thus, a magnetic field necessary for magnetic saturation in the axis direction in which magnetization of magnetic body 330 having in-plane magnetic anisotropy is difficult (normal direction D10*b*), for example, is much larger than a magnetic field necessary for magnetic saturation in the axis direction in which magnetization of magnetic body 340 having normal magnetic anisotropy is easy (normal direction D10*b*). A magnetic field necessary for magnetic saturation in the axis direction in which magnetization of magnetic body 40 is difficult (in-plane direction D10*a*) is much larger than a magnetic field necessary for magnetic saturation in the axis direction in which magnetization of magnetic body 30 is easy (in-plane direction D10*a*). Thus, coercive forces of magnetic bodies 330 and 340 in the directions of axes of easy magnetization are compared so that magnetization is first performed on one of the magnetic material having a larger coercive force and then on the other, in the axis direction in which magnetization of the magnetic material is easy. In the case where a coercive force in the axis direction in which magnetization of magnetic body 330 is easy (in-plane direction D10*a*) is equal to a coercive force in the axis direction in which magnetization of magnetic body 340 is easy (normal direction D10*b*), a magnetic field necessary for saturation in magnetic body 340 under the influence of a demagnetizing field is larger. In view of this, magnetic body 340 is first magnetized.

In the magnetizing of magnetic body 330, this magnetization is preferably performed with magnetic fluxes larger than a magnetic field necessary for magnetic saturation of magnetic body 330 and smaller than a coercive force of magnetic body 340.

The above manufacturing method allows magnetic body 330 to generate a magnetic field in in-plane direction D10*a*, and allows magnetic body 340 to generate a magnetic field in normal direction D10*b*.

The order of intensities of magnetic fields necessary for magnetic saturation is reversed from the order described above between in-plane direction D10*a* and normal direction D10*b* depending on various conditions such as a composition ratio of Sm and Co, crystal orientation, particle size, an additive, and a combination of these conditions. When the order is reversed, the order of performing magnetization may be reversed.

In accordance with Embodiment 2, the heat treatment and the magnetization are performed separately, but may be performed simultaneously.

2-3. Advantages and Others

As described above, in thin film magnet 300 according to Embodiment 2, magnetic bodies 330 and 340 exhibiting different orientations are formed on single surface 810. Thus, thin film magnet 300 having magnetocrystalline anisotropy in in-plane direction D10*a* and normal direction D10*b* can be obtained at once.

Exemplary Embodiment 3

Figure 8:
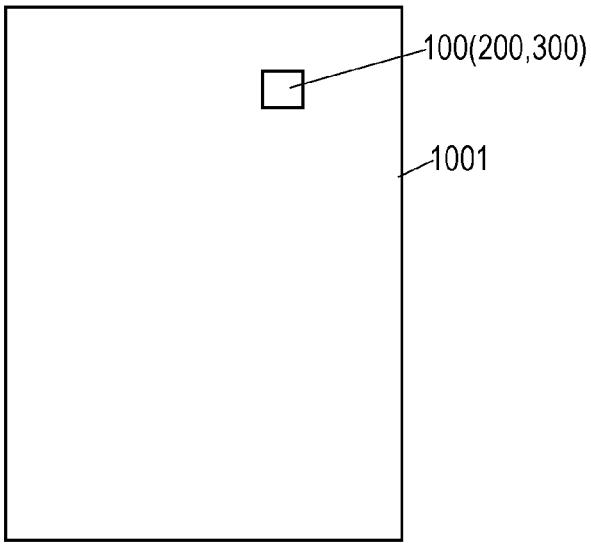
FIG. 8 is a schematic view of an electronic device according to Exemplary Embodiment 3.

FIG. 8 is a schematic view of electronic device 1001 according to Exemplary Embodiment 3. Electronic device 1001 includes thin film magnet 100 (200, 300) according to Embodiment 1 or 2. Electronic device 1001 is, for example, a sensor, an actuator, or a motor.

Although the foregoing description is directed to the thin film magnets according to exemplary embodiments of the present disclosure, the present disclosure is not limited to these embodiments.

For example, although $Sm_xCo_y$ as a specific example of a rare-earth element (R)-cobalt (Co) compound is used for a material constituting a magnetic layer in accordance with the above embodiments, a material constituting a magnetic layer is not limited to this, and Pr, Nd, Y, La, or Gd may be used as the rare-earth element. A material in which part of Co in $Sm_xCo_y$ is replaced by Cu and Fe may be used, or a material in which Zr or other elements is mixed as an additive may be used. Alternatively, Co may be replaced by Fe, that is, $Sm_2Fe_{17}N_3$ may be used.

As described above, the material of the oxidation-inhibiting layer is not limited to a material containing Ta, and may include Nb, W, or Mo, instead of Ta. The same material may be used for all the oxidation-inhibiting layers, or different materials may be used for the oxidation-inhibiting layers.

The substrate is not limited to a Si substrate having a thermal oxidation film of $SiO_2$ formed at a surface thereof, and may be, for example, a single crystalline substrate, such as heat-resistant glass, a sapphire substrate, or a MgO substrate, a ceramic (containing, as main component, $Al_2O_3$, $ZrO_2$, or MgO) substrate, or a substrate including a ceramic substrate and a heat-resistant glass glaze on the ceramic substrate.

The oxidation-inhibiting layer and the magnetic layer intermediate layer may be formed by sputtering as described in accordance with the above embodiments or may be formed by other methods. The heat treatment temperature is not limited to the temperatures described above, and may be changed appropriately depending on materials.

In accordance with Embodiments 1 and 2, the configurations and the manufacturing methods are described using thin film magnets, that is, magnetic materials, as an example. However, the configurations and the production methods are also applicable to other materials, such as a piezoelectric material as well as the magnetic material.

The present disclosure is not limited to the exemplary embodiments. Embodiments in which variations conceivable to those skilled in the art are made on the exemplary embodiments and embodiments using combinations of components of different exemplary embodiments may be included within the range of one or more aspects, as long as these embodiments are within the gist of the present disclosure.

As described above, thin film magnet 100 according to Embodiment 1 includes substrate 10, amorphous oxidation-inhibiting layer 20*a* provided on substrate 10, magnetic body 30 provided on oxidation-inhibiting layer 20*a*, amorphous oxidation-inhibiting layer 20*b* provided on magnetic body 30, magnetic body 40 provided on oxidation-inhibiting layer 20*b*, and amorphous oxidation-inhibiting layer 20*c* provided on magnetic body 40. Magnetic body 30 includes magnetic layer 31 provided on oxidation-inhibiting layer 20*a*, intermediate layer 32 provided on magnetic layer 31, and magnetic layer 33 provided on intermediate layer 32. Intermediate layer 32 includes metal particles 32*p*. Magnetic body 40 includes magnetic layer 41 provided on oxidation-inhibiting layer 20*b*, intermediate layer 42 provided on magnetic layer 41, and magnetic layer 43 provided on intermediate layer 42. Intermediate layer 42 includes metal particles 42*p*. One of magnetic bodies 30 and 40 has magnetocrystalline anisotropy in in-plane direction D10*a* that is parallel to surface 810 of substrate 10. The other of magnetic bodies 30 and 40 has magnetocrystalline anisotropy in normal direction D10*b* that is perpendicular to surface 810 of substrate 10.

This configuration provides magnetic bodies 30 and 40 exhibiting different orientations stacked by a single manufacturing process, hence providing thin film magnet 100 in which magnetic bodies 30 and 40 having magnetocrystalline anisotropy in in-plane direction D10*a* and normal direction D10*b*, respectively, are stacked on single substrate 10. In addition, thin film magnet 100 has a high energy product, a sufficiently large coercive force, and a high residual flux density.

Each of oxidation-inhibiting layers 20*a*, 20*b*, and 20*c* may contain at least one of tantalum (Ta), niobium (Nb), tungsten (W), and molybdenum (Mo).

This configuration provides oxidation-inhibiting layers 20*a*, 20*b*, and 20*c* having high oxidation reduction function.

Thin film magnet 300 according to Embodiment 2 includes substrate 10, amorphous oxidation-inhibiting layer 320*a* provided on substrate 10, magnetic body 330 provided on oxidation-inhibiting layer 320*a*, amorphous oxidation-inhibiting layer 321*b* provided on magnetic body 330, amorphous oxidation-inhibiting layer 320*c* provided on substrate 10, magnetic body 340 provided on oxidation-inhibiting layer 320*c*, and amorphous oxidation-inhibiting layer 320*d* provided on magnetic body 340. Magnetic body 330 includes magnetic layer 331 provided on oxidation-inhibiting layer 320*a*, intermediate layer 332 provided on magnetic layer 331, and magnetic layer 333 provided on intermediate layer 332. Intermediate layer 332 includes metal particles 332*p*. Magnetic body 340 includes magnetic layer 341 provided on oxidation-inhibiting layer 320*c*, intermediate layer 342 provided on magnetic layer 341, and magnetic layer 343 provided on intermediate layer 342. Intermediate layer 342 includes metal particles 342*p*. One of magnetic bodies 330 and 340 has magnetocrystalline anisotropy in in-plane direction D10*a* that is parallel to surface 810 of substrate 10. The other of magnetic bodies 330 and 340 has magnetocrystalline anisotropy in normal direction D10*b* that is perpendicular to surface 810 of substrate 10.

In this configuration, magnetic bodies 330 and 340 exhibiting different orientations are formed in a single plane by a single manufacturing process so that thin film magnet 300 having magnetocrystalline anisotropy in in-plane direction D10*a* and normal direction D10*b* can be formed by a single manufacturing process.

Each of oxidation-inhibiting layers 320*a*, 320*b*, 320*c*, and 320*d* may contain at least one of tantalum (Ta), niobium (Nb), tungsten (W), and molybdenum (Mo).

This configuration provides oxidation-inhibiting layers 320*a*, 320*b*, 320*c*, and 320*d* having high oxidation suppressing function.

One of intermediate layer 32 (332) and intermediate layer 42 (342) may be constituted by a crystal with a cubic crystal structure oriented in the (110) direction or a crystal with a hexagonal crystal structure oriented in the (11-20) direction. The other of intermediate layer 32 (332) and intermediate layer 42 (342) may be constituted by a crystal with a cubic crystal structure oriented in the (111) direction or a crystal with a hexagonal crystal structure oriented in the (0001) direction.

This configuration allows orientations of magnetic layers 31, 33, 41, and 43 (331, 333, 341, and 343) to be easily controlled in in-plane direction D10*a* or normal direction D10*b* in accordance with orientations of intermediate layers 32 and 42 (332 and 342).

The crystal with a cubic crystal structure oriented in the (110) direction or the crystal with a hexagonal crystal structure oriented in the (11-20) direction is a crystal containing at least one of cobalt (Co) and iron (Fe). The crystal with a cubic crystal structure oriented in the (111) direction or the crystal with a hexagonal crystal structure oriented in the (0001) direction may be a crystal containing titanium (Ti) or zirconium (Zr).

With this configuration, Co for intermediate layers 32 and 42 (332 and 342) allows orientations of magnetic layers 31, 33, 41, and 43 (331, 333, 341, and 343) to be easily controlled in in-plane direction D10*a*. In addition, Cu for intermediate layers 32 and 42 (332 and 342) allows orientations of magnetic layers 31, 33, 41, and 43 (331, 333, 341, and 343) to be easily controlled in normal direction D10*b*.

Metal particles 32*p* (332*p*) are diffused in magnetic layer 31 (331) and magnetic layer 33 (333). The concentration of metal particles 32*p* (332*p*) in a part of magnetic layer 31 (331) may decrease as the distance from intermediate layer 32 (332) to the part of magnetic layer 31 (331) increases. The concentration of metal particles 32*p* (332*p*) in a part of magnetic layer 33 (333) may decrease as the distance from intermediate layer 32 (332) to the part of magnetic layer 33 (333) increases. In addition, metal particles 42*p* (342*p*) are diffused in magnetic layer 41 (341) and magnetic layer 43 (343). The concentration of metal particles 42*p* (342*p*) in a part of magnetic layer 41 (341) may decrease as the distance from intermediate layer 42 (342) to the part of magnetic layer 41 (341) increases. The concentration of metal particles 42*p* (342*p*) in a part of magnetic layer 43 (343) may decrease as the distance from intermediate layer 42 (342) to the part of magnetic layer 43 (343) increases.

In this configuration, metal particles 32*p* and 42*p* (332*p* and 342*p*) diffused in intermediate layers 32 and 42 (332 and 342) allows orientations of magnetic layers 31, 33, 41, and 43 (331, 333, 341, and 343) to be easily controlled in in-plane direction D10*a* or normal direction D10*b* in accordance with orientations of intermediate layers 32 and 42 (332 and 342).

In one of magnetic body 30 (330) and magnetic body 40 (340), a crystal may be oriented such that magnetocrystalline anisotropy isotropically occurs in in-plane direction D10*a*.

With this configuration, on the same substrate 10, thin film magnet 100 (300) having coercive forces in arbitrary directions of in-plane direction D10*a* and normal direction D10*b* can be formed at once.

Intermediate layer 32 (332) may have a crystallization temperature lower than that of magnetic layer 31 (331). Intermediate layer 42 (342) may have a crystallization temperature lower than that of magnetic layer 41 (341).

With this configuration, even when intermediate layers 32 and 42 (332 and 342) are crystallized, magnetic layers 31 and 41 (331 and 341) can be maintained in an amorphous state.

Each of magnetic layers 31, 33, 41, and 43 (331, 333, 341, and 343) may contain Co and one of Sm, Pr, Nd, Y, La, and Gd.

With this configuration, a material, such as $Sm_xCo_y$, containing Sm for magnetic layers 31, 33, 41, and 43 (331, 333, 341, and 343) provides a thin film magnet having a high energy product.

Thin film magnet 100 can be manufactured by the following method. First, oxidation-inhibiting layer 20*a* in an amorphous state is formed on substrate 10. Magnetic layer 31 in an amorphous state is formed on oxidation-inhibiting layer 20*a*. Intermediate layer 32 including metal particles 32*p* is formed on magnetic layer 31. Magnetic layer 33 in an amorphous state is formed on intermediate layer 32. Oxidation-inhibiting layer 20*b* in an amorphous state is formed on magnetic layer 33. Magnetic layer 41 in an amorphous state is formed on oxidation-inhibiting layer 20*b*. Intermediate layer 42 including metal particles 42*p* is formed on magnetic layer 41. Magnetic layer 43 in an amorphous state is formed on intermediate layer 42. Oxidation-inhibiting layer 20*c* in an amorphous state is formed on magnetic layer 43. A heat treatment is performed on oxidation-inhibiting layers 20*a*, 20*b*, and 20*c*, magnetic layers 31, 33, 42, and 43, and intermediate layers 32 and 42. The heat treatment allows magnetic layers 31 and 33 and intermediate layer 32 to constitute magnetic body 30. Magnetic layers 41 and 43 and intermediate layer 42 constitute magnetic body 40. One of magnetic bodies 30 and 40 has magnetocrystalline anisotropy in in-plane direction D10*a* that is parallel to surface 810 of substrate 10. The other of magnetic bodies 30 and 40 has magnetocrystalline anisotropy in normal direction D10*b* that is perpendicular to surface 810 of substrate 10.

With this configuration, magnetic bodies 30 and 40 exhibiting different orientations are stacked by a single manufacturing process, thus providing thin film magnet 100 in which magnetic bodies 30 and 40 having magnetocrystalline anisotropy in in-plane direction D10*a* and normal direction D10*b* are stacked on single substrate 10. Thin film magnet 100 has a high energy product, a sufficiently large coercive force, and a high residual flux density.

One of intermediate layers 32 and 42 may be constituted by a crystal with a cubic crystal structure oriented in the (110) direction or a crystal with a hexagonal crystal structure oriented in the (11-20) direction. The other of intermediate layers 32 and 42 may be constituted by a crystal with a cubic crystal structure oriented in the (111) direction or a crystal with a hexagonal crystal structure oriented in the (0001) direction.

This configuration allows orientations of magnetic layers 31, 33, 41, and 43 to be easily controlled in in-plane direction D10*a* or normal direction D10*b* in accordance with orientations of intermediate layers 32 and 42.

In the process of forming magnetic layers 31, 33, 41, and 43, magnetic layers 31, 33, 41, and 43 may be made of a material containing Co and at least one of Sm, Pr, Nd, Y, La, and Gd.

With this configuration, a material, such as $Sm_xCo_y$, containing Sm for magnetic layers 31, 33, 41, and 43 provides thin film magnet 100 having a high energy product.

In the process of forming magnetic layers 31, 33, 41, and 43, magnetic layers 31, 33, 41, and 43 may be formed in an amorphous state. In the process of forming intermediate layers 32 and 42, intermediate layers 32 and 42 may be formed by crystallization. Magnetic layers 31, 33, 41, and 43 may be crystallized by the heat treatment.

This configuration allows orientations of magnetic layers 31, 33, 41, and 43 to be easily controlled in accordance with orientations of intermediate layers 32 and 42.

In the process of forming magnetic layers 31, 33, 41, and 43, magnetic layers 31, 33, 41, and 43 may be formed at the surface temperature of substrate 10 equal to or lower than 400° C. In the process of forming intermediate layers 32 and 42, intermediate layers 32 and 42 may be formed at the surface temperature of substrate 10 equal to or lower than 400° C. The heat treatment may be performed on oxidation-inhibiting layers 20*a*, 20*b*, and 20*c*, magnetic layers 31, 33, 41, and 43, and intermediate layers 32 and 42 at the surface temperature of substrate 10 equal to or higher than 500° C.

With this configuration, in the forming of intermediate layer 32, intermediate layer 32 can be crystallized, and magnetic layer 31 can be maintained in an amorphous state. In addition, in the forming of intermediate layer 42, intermediate layer 42 can be crystallized, and magnetic layer 41 can be maintained in an amorphous state. Thus, orientations of magnetic layers 31 and 33 can be easily controlled in accordance with orientation of intermediate layer 32. Orientations of magnetic layers 41 and 43 can be easily controlled in accordance with orientation of intermediate layer 42.

Thin film magnet 300 can be manufactured by the following method. Oxidation-inhibiting layer 420*a* in an amorphous state is formed on substrate 10. Magnetic layer 431 in an amorphous state is formed on oxidation-inhibiting layer 420*a*. Intermediate layer 432 including metal particles 332*p* is formed on magnetic layer 431. Intermediate layer 442 including metal particles 342*p* is formed on magnetic layer 431. Magnetic layer 433 in an amorphous state is formed on intermediate layers 432 and 442. Oxidation-inhibiting layer 420*b* in an amorphous state is formed on magnetic layer 433. Hole 380 penetrating oxidation-inhibiting layers 420*a* and 420*b* and magnetic layers 431 and 433 is formed. After the formation of hole 380, a heat treatment is performed on oxidation-inhibiting layers 420*a* and 420*b*, magnetic layers 431 and 433, and intermediate layers 432 and 442. The heat treatment allows a portion of magnetic layer 431 located below intermediate layer 332 (magnetic layer 331), intermediate layer 332, and a portion of magnetic layer 433 located above intermediate layer 332 (magnetic layer 333) to constitute magnetic body 330. The heat treatment also allows a portion of magnetic layer 431 located below intermediate layer 342 (magnetic layer 341), intermediate layer 342, and a portion of magnetic layer 433 located above intermediate layer 342 (magnetic layer 343) to constitute magnetic body 340. One of magnetic bodies 330 and 340 has magnetocrystalline anisotropy in in-plane direction D10*a* that is parallel to surface 810 of substrate 10. The other of magnetic bodies 330 and 340 has magnetocrystalline anisotropy in normal direction D10*b* that is perpendicular to surface 810 of substrate 10.

In this configuration, magnetic bodies 330 and 340 exhibiting different orientations are formed in a single plane by a single manufacturing process, hence providing thin film magnet 300 having magnetic anisotropy in in-plane direction D10*a* and normal direction D10*b* by s single manufacturing process.

One of intermediate layers 332 and 342 may be constituted by a crystal with a cubic crystal structure oriented in the (110) direction or a crystal with a hexagonal crystal structure oriented in the (11-20) direction. The other of intermediate layers 332 and 342 may be constituted by a crystal with a cubic crystal structure oriented in the (111)

direction or a crystal with a hexagonal crystal structure oriented in the (0001) direction.

This configuration allows orientations of magnetic layers 331, 333, 341, and 343 to be easily controlled in in-plane direction D10*a* or normal direction D10*b* in accordance with orientations of intermediate layers 332 and 342.

In the process of forming magnetic layers 431 and 433, each of magnetic layers 431 and 433 may be made of a material containing Co and at least one of Sm, Pr, Nd, Y, La, and Gd.

With this configuration, a material, such as $Sm_xCo_y$, containing Co and at least one of Sm, Pr, Nd, Y, La, and Gd for magnetic layers 431 and 433 provides thin film magnet 300 with a high energy product.

In the process of forming magnetic layers 432 and 442, magnetic layers 432 and 442 may be formed by crystallization, and magnetic layers 331, 333, 341, and 343 may be crystallized by heat treatment.

This configuration allows orientations of magnetic layers 331, 333, 341, and 343 to be easily controlled in accordance with orientations of intermediate layers 332 and 342.

In the process of forming magnetic layers 431 and 433, magnetic layers 431 and 433 may be formed at the surface temperature of substrate 10 equal to or lower than 400° C. In the process of forming intermediate layers 432 and 442, intermediate layers 432 and 442 may be formed at the surface temperature of substrate 10 equal to or lower than 400° C. In the process of performing the heat treatment, heat treatment may be performed on oxidation-inhibiting layers 320*a* to 320*d*, magnetic layers 331, 333, 341, and 343, and intermediate layers 332 and 342 at the surface temperature of substrate 10 equal to or higher than 500° C.

With this configuration, in the forming of intermediate layers 332 and 342, intermediate layer 332 and 342 can be crystallized, and magnetic layer 331 and magnetic layer 333 can be maintained in an amorphous state. Orientations of magnetic layers 331, 333, 341, and 343 can be easily controlled in accordance with orientations of intermediate layers 332 and 342.

Intermediate layer 442 may be disposed adjacent to intermediate layer 432 at boundary portion P300. In this case, hole 380 including boundary portion P300 may penetrate oxidation-inhibiting layers 420*a* and 420*b*, magnetic layers 431 and 433, and intermediate layers 432 and 442.

Exemplary Embodiment 4

4-1. Configuration of Thin Film Magnet

Figure 9:
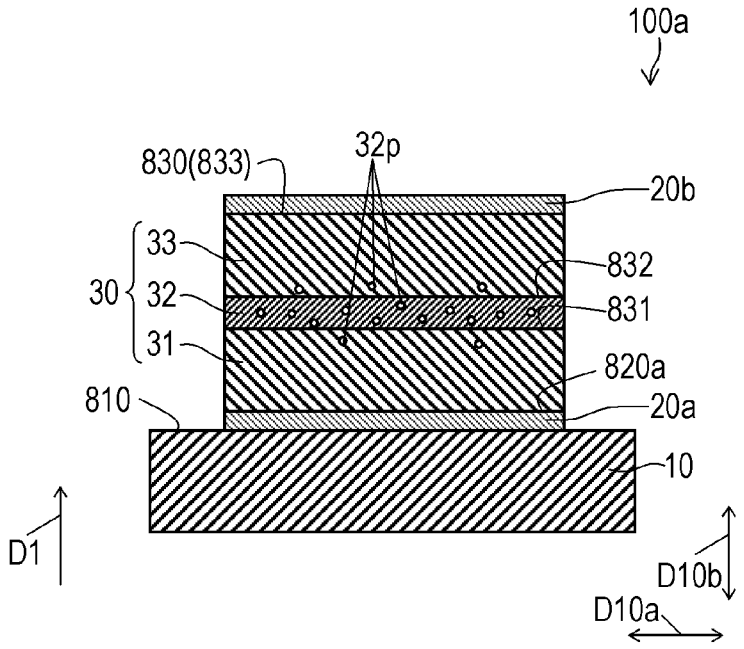
FIG. 9 is a cross-sectional view of a thin film magnet according to Exemplary Embodiment 4.

FIG. 9 is a cross-sectional view of thin film magnet 100*a* according to Exemplary Embodiment 4. In FIG. 9, components identical to those of thin film magnet 1 according to Embodiment 1 illustrated in FIG. 1A are denoted by the same reference numerals. Thin film magnet 100*a* has the same configuration as thin film magnet 1 according to Embodiment 1 illustrated in FIG. 1A.

4-2. Method for Manufacturing Thin Film Magnet

Figure 10:
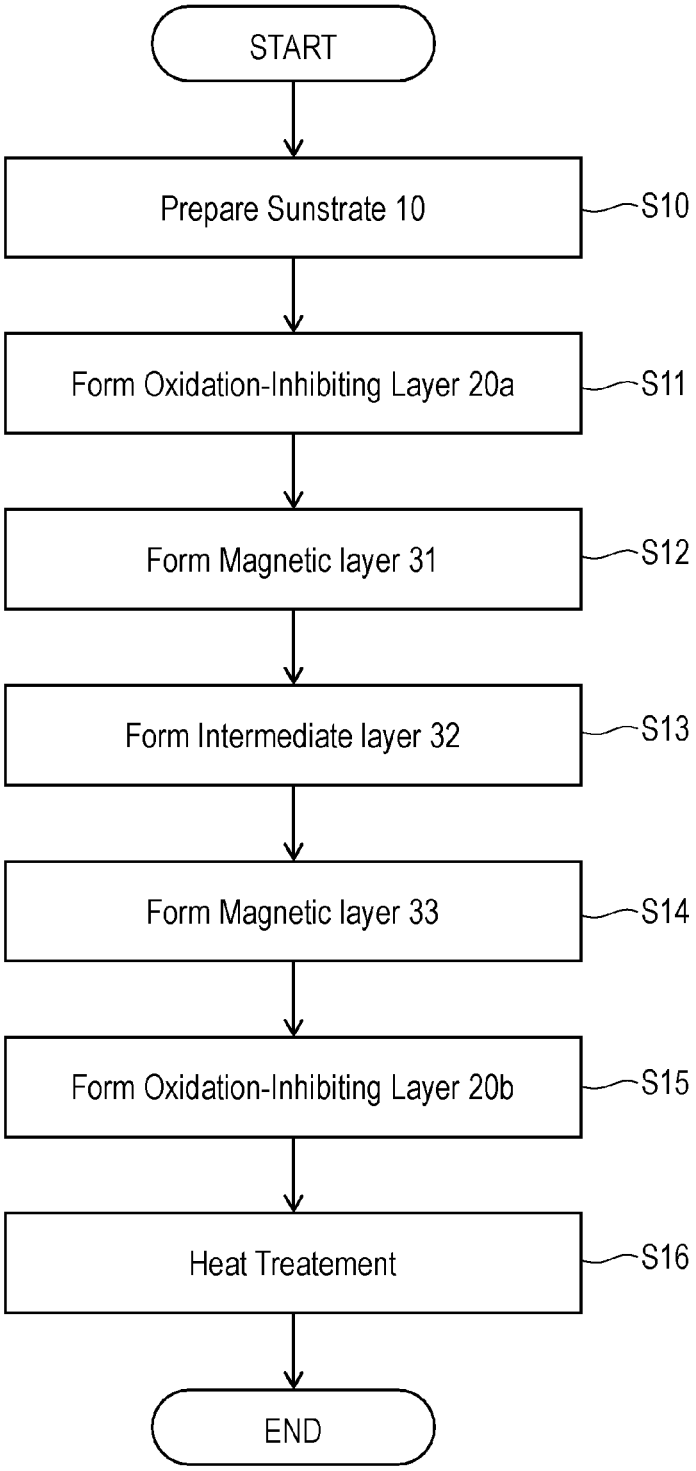
FIG. 10 is a flowchart showing processes for manufacturing the thin film magnet according to Embodiment 4.

A method for manufacturing thin film magnet 100*a* according to Embodiment 4 will be described below. FIG. 10 is a flowchart of processes for manufacturing thin film magnet 100*a*.

As indicated in FIG. 10, to manufacture thin film magnet 100*a*, substrate 10 is first prepared (step S10). As substrate 10, a Si substrate having a thermal oxidation film of $SiO_2$ formed at a surface thereof is used as described above.

Next, oxidation-inhibiting layer 20*a* is formed on upper surface 810 of substrate 10 by a thin film formation technique (step S11). Oxidation-inhibiting layer 20*a* is formed by depositing Ta by sputtering. At this moment, oxidation-inhibiting layer 20*a* deposited on upper surface 810 of substrate 10 is in an amorphous state. The metal contained in each of oxidation-inhibiting layers 20*a* and 20*b* is not limited to Ta, and may include at least one of Ta, Nb, W, and Mo.

Then, magnetic layer 31 is formed on upper surface 820*a* of oxidation-inhibiting layer 20*a* by a thin film formation technique (step S12). Magnetic layer 31 is formed by depositing $Sm_xCo_y$ by sputtering. In the forming of magnetic layer 31, the surface temperature of substrate 10 is equal to or lower than 400° C. The surface temperature of substrate 10 equal to or lower than 400° C. allows magnetic layer 31 to be formed at a temperature lower than a crystallization temperature of $Sm_xCo_y$ in order to maintain magnetic layer 31 in an amorphous state.

The surface temperature of substrate 10 is determined based on a result obtained by previously measuring the temperature of another substrate having the same thermal capacity as substrate 10 with a thermocouple embedded in the substrate. The lower limit of the temperature of substrate 10 may be a room temperature in consideration of a reaction rate of sputtering and cooling ability. In the case of using a device having cooling ability, the lower limit of the temperature of substrate 10 may be lower than a room temperature.

The temperature of substrate 10 is thus lower than the crystallization temperature of $Sm_xCo_y$ so that the crystal structure of magnetic layer 31 immediately after deposition of $Sm_xCo_y$ by sputtering is maintained in an amorphous state.

Then, intermediate layer 32 is formed on upper surface 831 of magnetic layer 31 by a thin film formation technique (step S13). Intermediate layer 32 is formed by depositing Co by sputtering. Similarly to the formation of magnetic layer 31, in the forming of intermediate layer 32, the temperature of substrate 10 is equal to or lower than 400° C. This configuration reduces crystallization of magnetic layer 31, and maintains magnetic layer 31 in an amorphous state. Co constituting intermediate layer 32 is crystallized and oriented in the (110) direction. In order to crystallize Co oriented in the (110) direction, formation conditions of sputtering are controlled.

After that, magnetic layer 33 is formed on upper surface 832 of intermediate layer 32 by a thin film formation technique (step S14). Magnetic layer 33 is formed by depositing $Sm_xCo_y$ by sputtering. Similarly to the formation of magnetic layer 31, in the forming of magnetic layer 33, the temperature of substrate 10 is equal to or lower than 400° C. The crystal structure of magnetic layer 33 immediately after deposition of $Sm_xCo_y$ by sputtering is maintained in an amorphous state.

As an example, the temperature in the forming of magnetic layer 31, intermediate layer 32, and magnetic layer 33 may be a room temperature. The surface temperature of substrate 10 at starting formation of these layers may range from 16° C. to 25° C.

Subsequently, oxidation-inhibiting layer 20*b* is formed on upper surface 833 of magnetic layer 33 by a thin film formation technique (step S15). Similarly to oxidation-inhibiting layer 20*a*, oxidation-inhibiting layer 20*b* is formed by depositing Ta by sputtering. At this moment, oxidation-inhibiting layer 20*b* deposited on upper surface 833 of magnetic layer 33 is in an amorphous state.

Next, substrate 10 having oxidation-inhibiting layer 20*a*, magnetic layer 31, intermediate layer 32, magnetic layer 33, and oxidation-inhibiting layer 20*b* formed thereon is crystallized by a heat treatment (step S16). The heat treatment is preferably performed in a vacuum atmosphere, a reduction atmosphere, or a non-oxidizing atmosphere. The vacuum atmosphere is preferably an ultrahigh vacuum or extremely high vacuum atmosphere from which residual oxygen and residual water are sufficiently removed. The reduction atmosphere is preferably a hydrogen atmosphere in which replacement with hydrogen is performed after evacuation to an extremely high vacuum. The non-oxidizing atmosphere is preferably an atmosphere in which replacement with argon (Ar) is performed after evacuation to an extremely high vacuum.

The temperature of the heat treatment is determined such that the surface temperature of substrate 10 is equal to or higher than 500° C. The upper limit of the temperature of heat treatment on substrate 10 is not specifically limited, and may be within a range in which magnetic layers 31 and 33 are not oxidized by, e.g. a $SO_2$ carrier gas supplied from the device for heat treatment and diffused into magnetic body 30. The heat treatment temperature is preferably lower than the crystallization temperatures of oxidation-inhibiting layers 20*a* and 20*b* in order to maintain oxidation-inhibiting layers 20*a* and 20*b* in an amorphous state.

As an example, crystallization by heat treatment may be performed in a vacuum at a surface temperature of substrate 10 equal to or higher than 500° C. or and equal to or lower than 700° C. The back pressure of the device before the start of heating may be equal to or lower than $10^{-4}$ Pa while the pressure in heating may equal to or lower than $5\times10^{-4}$ Pa.

The temperature and vacuum conditions of substrate 10 in performing the heat treatment are not limited to these conditions, and may be an atmosphere that can suppress oxidation of magnetic layers 31 and 33 due to diffusion of a $SO_2$ carrier gas into magnetic body 30. For example, the degree of vacuum in the heat treatment may be equal to or lower than $10^{-3}$ Pa.

The heat treatment allows metal particles 32*p* of Co constituting intermediate layer 32 to be diffused into magnetic layers 31 and 33. Magnetic layers 31 and 33 are crystallized. In this crystallization, magnetic layers 31 and 33 are oriented in accordance with orientation of intermediate layer 32. As described above, in the case of using Co oriented in the (110) direction for intermediate layer 32, in thin film magnet 100*a* after the heat treatment, magnetic layers 31 and 33 are oriented such that the (11-20) plane of $Sm_xCo_y$ as a hexagonal crystal or a rhombohedral crystal is parallel to surface 810 of substrate 10. Thus, magnetic layers 31 and 33 have magnetocrystalline anisotropy in in-plane direction D10*a*.

In the process of forming intermediate layer 32 described above, in a case where intermediate layer 32 is constituted by Cu oriented in the (111) direction instead of Co oriented in the (110) direction, in thin film magnet 100*a* after the heat treatment, magnetic layers 31 and 33 are oriented such that the (0001) plane of $Sm_xCo_y$ as a hexagonal crystal or a rhombohedral crystal is parallel to surface 810 of substrate 10. Thus, magnetic layers 31 and 33 have magnetocrystalline anisotropy in normal direction D10*b*.

The crystal structure and magnetic properties of thin film magnet 100*a* manufactured by the method described above were evaluated in the following manner.

4-3. Evaluation of Crystal Structure of Thin Film Magnet

First, the crystal structure of thin film magnet 100*a* was evaluated.

Figure 11:
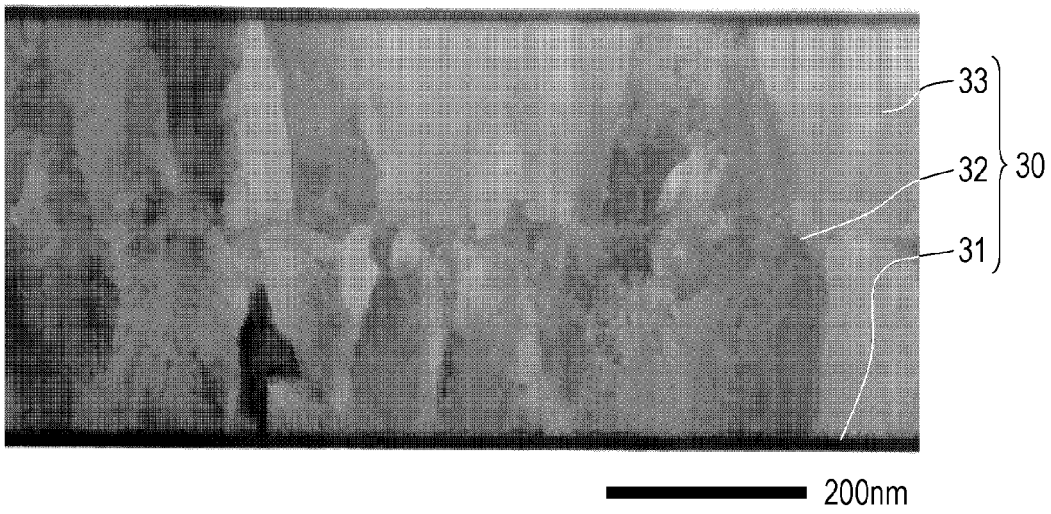
FIG. 11 is a scanning-type transmission electron microscopic image after heat treatment of the thin film magnet according to Embodiment 4.
Figure 12:
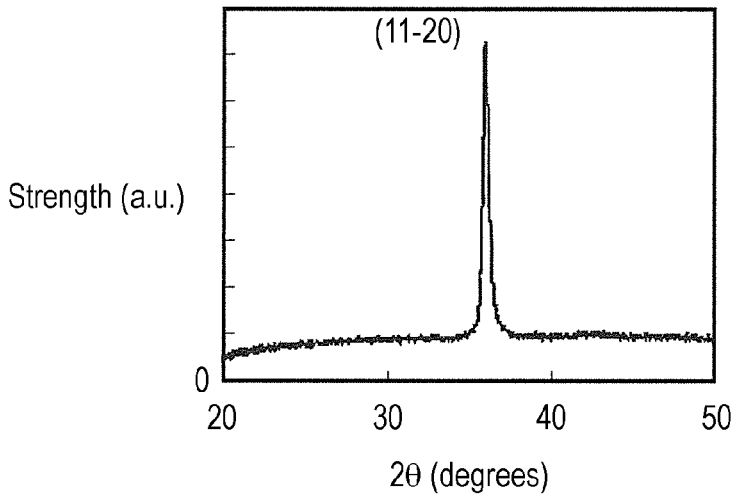
FIG. 12 shows a crystal structure of the thin film magnet according to Embodiment 4 after heat treatment.

The crystal structure of thin film magnet 100*a* in the case of using Co oriented in the (110) direction for intermediate layer 32 will be first described below. FIG. 11 is a scanning-type transmission electron microscopic image of thin film magnet 100*a* according to Embodiment 4 after the heat treatment. FIG. 12 shows a crystal structure of thin film magnet 100*a* after the heat treatment.

As shown in FIG. 11, in magnetic layers 31 and 33 of thin film magnet 100*a*, the crystal shape is elongated in the directions from intermediate layer 32 located at the center in stacking direction D1 to oxidation-inhibiting layers 20*a* and 20*b* located in upward and downward directions in the drawing sheet, that is, in stacking direction D1.

FIG. 12 shows a diffraction image of thin film magnet 100*a* obtained by a 2θ/θ method of X-ray diffraction. As shown in FIG. 12, thin film magnet 100*a* only has a peak indicating the (11-20) plane. That is, in thin film magnet 100*a*, the (11-20) plane of $Sm_xCo_y$ as a hexagonal crystal or a rhombohedral crystal is oriented with priority substantially in parallel with surface 810 of substrate 10.

Figure 13:
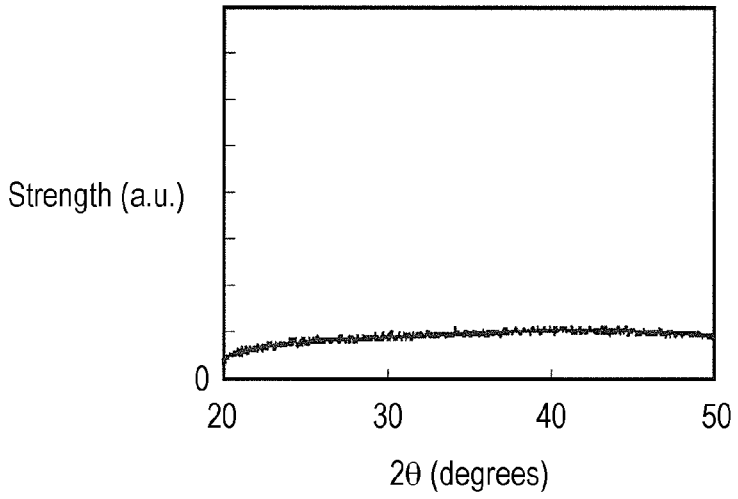
FIG. 13 shows a crystal structure of the thin film magnet before the heat treatment.

FIG. 13 shows a crystal structure of thin film magnet 100*a* before the heat treatment. FIG. 13 shows a diffraction image of thin film magnet 100*a* obtained by a 2θ/θ method of X-ray diffraction.

Thin film magnet 100*a* before the heat treatment does not exhibit diffraction indicating crystallization, as shown in FIG. 13. This is because magnetic layers 31 and 33 constituting most part of the volume of thin film magnet 100*a* are not crystallized and magnetic layers 31 and 33 have amorphous structures. An electron diffraction with a scanning-type transmission electron microscope demonstrates that the crystal of intermediate layer 32 is Co, which is a cubic crystal, and the plane oriented in parallel with surface 810 of substrate 10 is the (110) plane in thin film magnet 100*a* before the heat treatment. In thin film magnet 100*a* before the heat treatment, it was confirmed that oxidation-inhibiting layers 20*a* and 20*b* are also in an amorphous state.

In FIG. 13, no diffraction peak of cubic crystal due to Co constituting intermediate layer 32 at a (110) plane since intermediate layer 32 is much thinner than magnetic layers 31 and 33 and amorphous magnetic layer 33 disposed on intermediate layer 32 dissipates diffraction.

Thus, before the heat treatment, neither magnetic layer 31 nor magnetic layer 33 is crystallized, and the crystal structure of intermediate layer 32 is a cubic crystal, and the (110) plane of Co constituting intermediate layer 32 is oriented in parallel with surface 810 of substrate 10. It is also demonstrated that crystallization of magnetic layers 31 and 33 starts from intermediate layer 32 before the heat treatment. It is also demonstrated that, in the crystallization, metal particles 32*p* of Co included in intermediate layer 32 are diffused into magnetic layers 31 and 33 to form a crystal of $SmCo_5$ or $Sm_2Co_{17}$. It is also confirmed that the (11-20) plane of $Sm_xCo_y$ as a hexagonal crystal or a rhombohedral crystal that is the (110) plane of a crystal of $SmCo_5$ or $Sm_2Co_{17}$ is oriented in parallel with surface 810 of substrate 10. It is observed that oxidation-inhibiting layers 20*a* and 20*b* are in an amorphous state.

Figure 14:
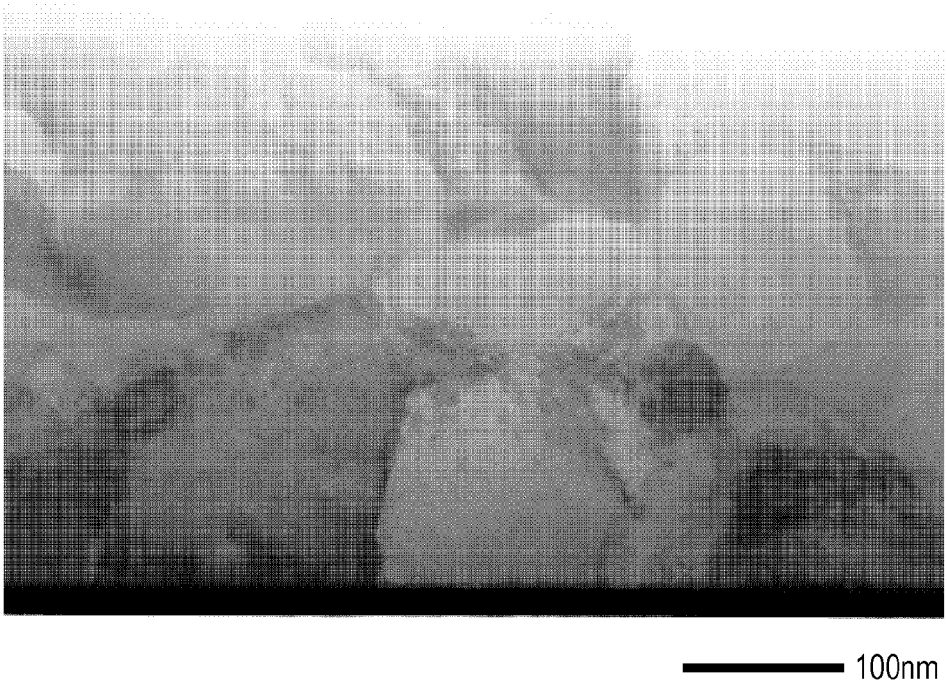
FIG. 14 is a scanning-type transmission electron microscopic image of a comparative example of a thin film magnet which does not include an intermediate layer.
Figure 15:
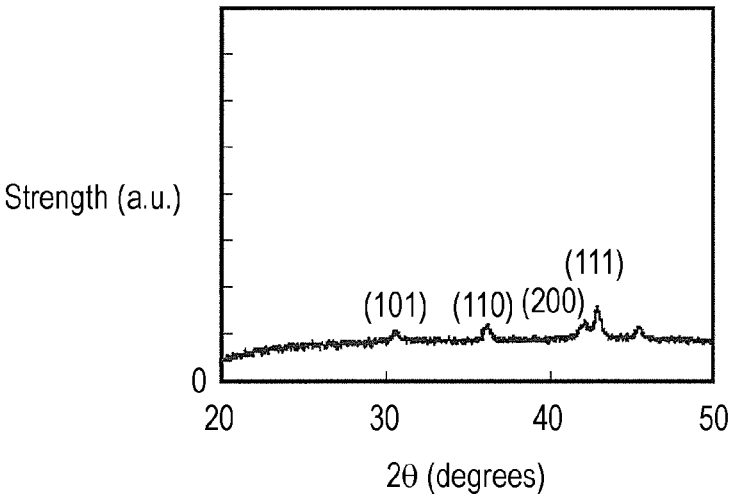
FIG. 15 shows a crystal structure of the comparative example of the thin film magnet.

A comparative example of a thin film magnet was prepared. The comparative example of the thin film magnet had the same configuration as thin film magnet 100*a* according to Embodiment 4 except for no intermediate layer. FIG. 14 is a scanning-type transmission electron microscopic image of the comparative example of the thin film magnet including no intermediate layer 32. FIG. 15 shows a crystal structure of the comparative example of the thin film magnet, and shows a diffraction image obtained by a 2θ/θ method of X-ray diffraction.

As shown in FIG. 14, the crystal of the comparative example of the thin film magnet including no intermediate layer 32 does not exhibit regularity in the crystal growth direction.

As shown in FIG. 15, in the crystal of the comparative example of the thin film magnet, plural diffraction peaks except for the (110) plane appear, and the intensity ratio thereof demonstrates that the crystal does not have crystal orientation in specific directions. Thus, it is confirmed that intermediate layer 32 causes magnetic layers 31 and 33 to exhibit crystalline orientation in specific directions.

Figure 16:
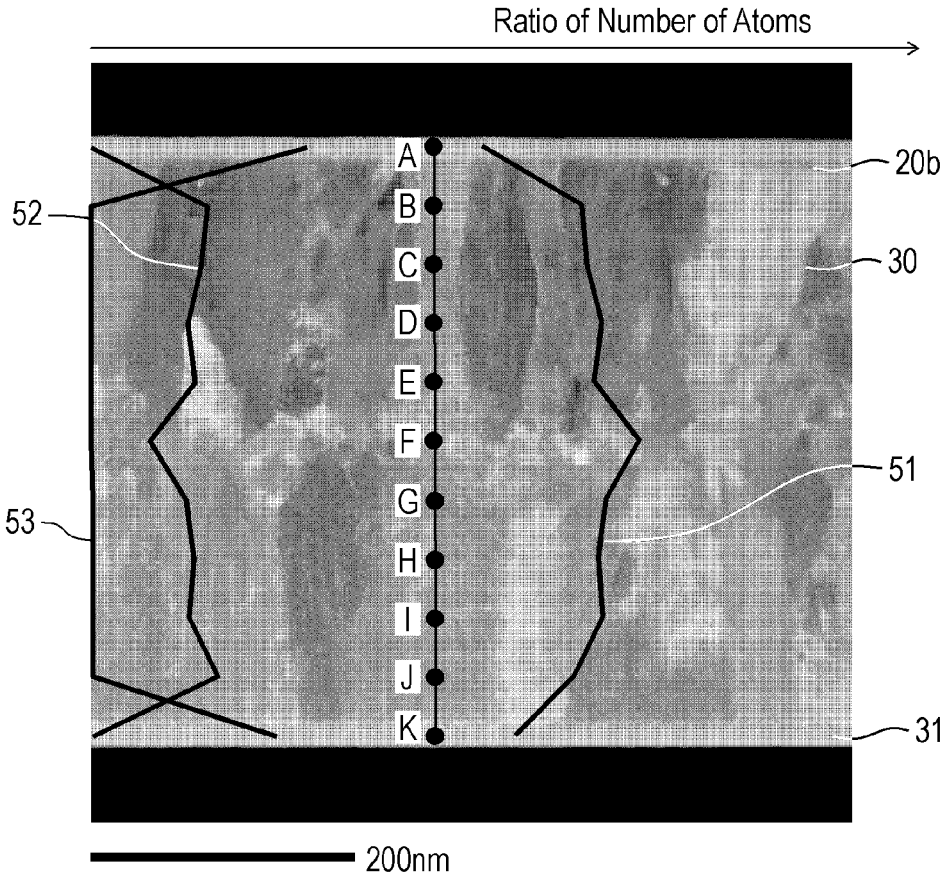
FIG. 16 is a scanning-type transmission electron microscopic image of the thin film magnet according to Embodiment after heat treatment.

FIG. 16 is a scanning-type transmission electron microscopic image of thin film magnet 100*a* according to Embodiment 4 after the heat treatment. FIG. 17 shows the composition of thin film magnet 100*a* illustrated in FIG. 16.

FIG. 16 shows a cross section of thin film magnet 100*a* except for substrate 10. FIG. 17 shows measurement results of a composition at eleven points A to K in thin film magnet 100*a*. In FIG. 16, the bottom of the drawing sheet is the side toward substrate 10. In FIG. 16, the numbers of Co atoms at eleven points A to K are indicated by polyline 51, the numbers of Sm atoms at eleven points A to K are indicated by polyline 52, and the numbers of Ta atoms at eleven points A to K are indicated by polyline 53. With respect to polylines 51, 52, and 53 in FIG. 16, the vertical direction in the drawing sheet corresponds to points A to K, and the horizontal direction in the drawing sheet corresponds to a proportion of the number of atoms of each elements. Polylines 51, 52, and 53 show that the proportion increases toward the right on the drawing sheet.

FIG. 17 shows measurement results of a component at eleven points A to K obtained by energy dispersive X-ray spectroscopy. Each numerical value shown in FIG. 17 indicates a proportion of the number of atoms of an element on a percentage basis.

FIGS. 16 and 17 show that the amount of a Ta component is locally larger at points A and K in thin film magnet 100*a* than those in portions around points A and K. Point A is a location corresponding to oxidation-inhibiting layer 20*b* while point K is a location corresponding to oxidation-inhibiting layer 20*a*. The results at points A and K show that atoms are mutually diffused at the interface between oxidation-inhibiting layer 20*a* and magnetic layer 31 and between oxidation-inhibiting layer 20*b* and magnetic layer 33, and Co of magnetic particles is diffused from magnetic layers 31 and 33 to oxidation-inhibiting layers 20*a* and 20*b*, respectively.

However, Co diffusion depends on the Ta volume in the oxidation-inhibiting layer and can be limited by reducing the thicknesses of oxidation-inhibiting layers 20*a* and 20*b*.

Diffusion of Co of magnetic particles from magnetic layers 31 and 33 to oxidation-inhibiting layers 20*a* and 20*b* causes Co of magnetic particles included in oxidation-inhibiting layer 20*a* and Ta included in magnetic layer 31 to form an alloy near the boundary between oxidation-inhibiting layer 20*a* and magnetic layer 31. Similarly, Co of magnetic particles included in oxidation-inhibiting layer 20*b* and Ta included in oxidation-inhibiting layer 20*b* form an alloy near the boundary between magnetic layer 33 and oxidation-inhibiting layer 20*b*. It is confirmed that these alloys are also in an amorphous state.

Oxidation-inhibiting layer 20*a* can suppress oxygen diffusion from $SiO_2$ as a constituent material of substrate 10 into magnetic layer 31. Oxidation-inhibiting layer 20*b* can suppress entering of oxygen into magnetic layer 33 from the outside. In this embodiment, a layer containing Ta, that is, each of oxidation-inhibiting layers 20*a* and 20*b*, has a thickness of about 10 nm in stacking direction D1, but may have a smaller thickness as long as the functions described above are obtained.

In FIGS. 16 and 17, at points B to E and points G to J, the concentration of Co is about 83% while the concentration of Sm is about 17%. The result of electron diffraction with a scanning-type transmission electron microscope confirmed that this configuration is the same crystal structure as $SmCo_5$. Points B to E are locations corresponding to magnetic layer 33 while points G to J are locations corresponding to magnetic layer 31.

On the other hand, at point F, the concentration of Co is about 90% while the concentration of Sm is about 10%. It is confirmed that this configuration is a crystal structure similar to $Sm_2Co_{17}$. It is also confirmed that films having different thicknesses in intermediate layer 32 have other crystal structures, such as $SmCo_5$. In the forming of thin film magnet 100*a*, in that case where Co as a main component of intermediate layer 32 has a large thickness, intermediate layer 32 includes a crystal of a cubic crystal, Co before the heat treatment, in addition to a crystal having a crystal structure. Point F is a location corresponding to intermediate layer 32, and is a phase including Co only or the same constituent element as magnetic layers 31 and 33 and has a composition and crystal structure different from that of Co only or magnetic layers 31 and 33. This phase is a phase having a higher residual flux density and a lower coercive force than magnetic layers 31 and 33 in terms of magnetic properties.

The reason why the Co percentage is not 100%, Sm is detected, and the Co concentration is about 90% accordingly at point F corresponding to intermediate layer 32 is because Sm at the boundary between intermediate layer 32 and each of magnetic layers 31 and 33 is diffused in the heat treatment process.

4-4. Evaluation of Magnetic Properties of Thin Film Magnet

Figure 18:
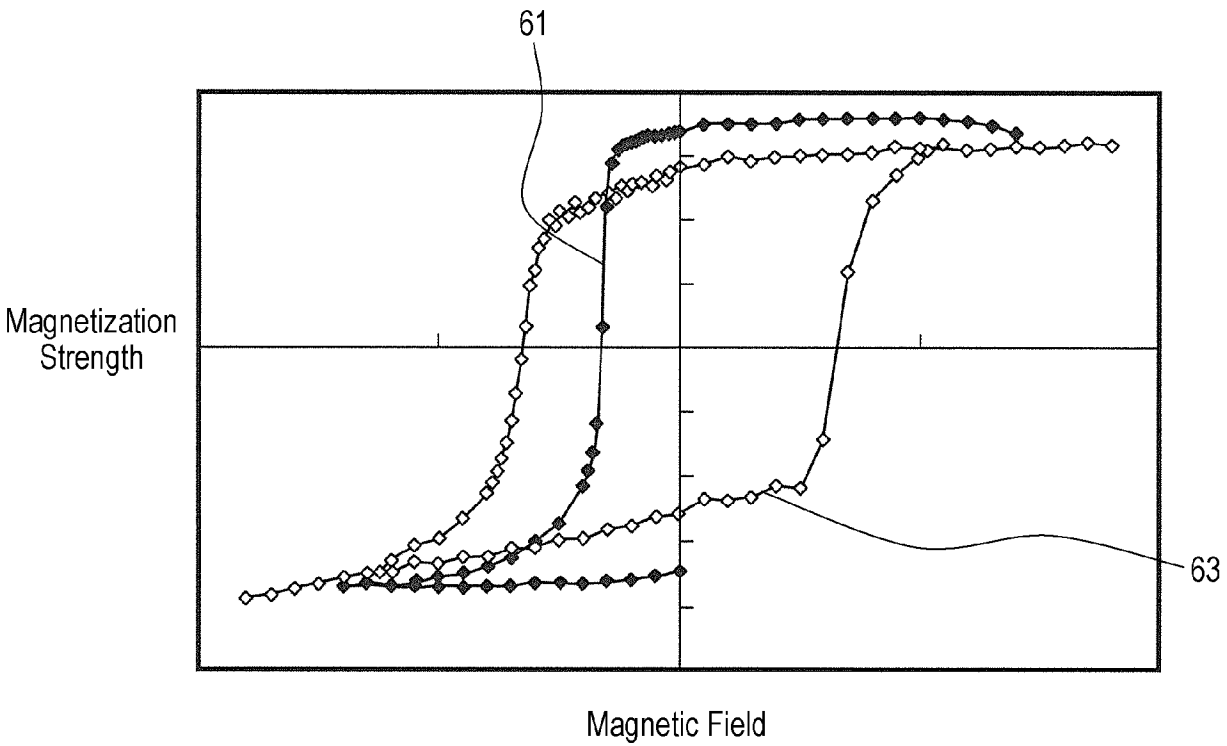
FIG. 18 shows magnetization curves of the thin film magnet according to Embodiment 4 and the comparative example of the thin film magnet.
Figure 19:
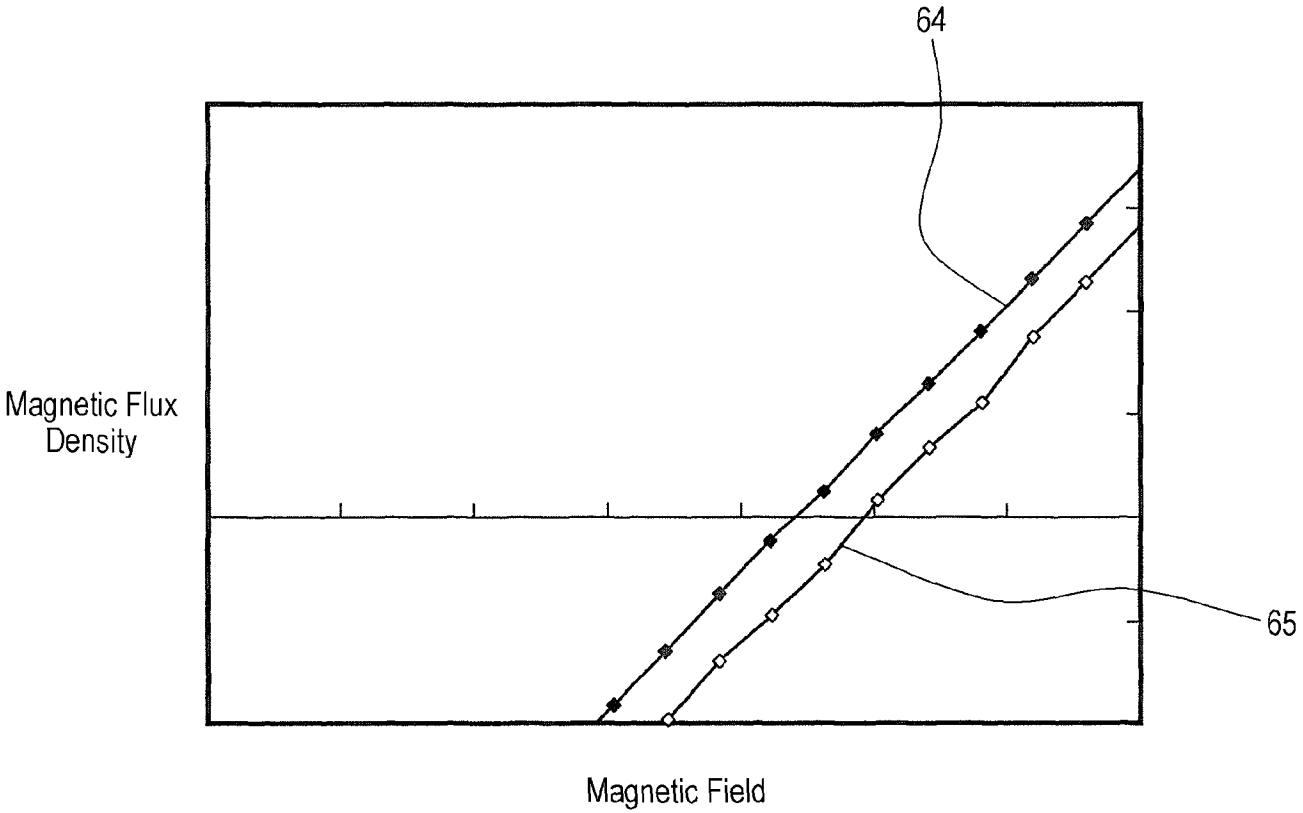
FIG. 19 shows second quadrants of B-H curves of the thin film magnet according to Embodiment 4 and the comparative example of the thin film magnet.

Next, magnetic properties of thin film magnet 100*a* were evaluated. The crystal structure of thin film magnet 100*a* in the case of using Co oriented in the (110) direction for intermediate layer 32 will be described below. FIG. 18 shows magnetization curves of thin film magnet 100*a* according to Embodiment 4 and the comparative example of the thin film magnet including no intermediate layer 32. FIG. 19 shows second quadrants of B-H curves of thin film magnet 100*a* according to Embodiment 4 and the comparative example of the thin film magnet.

FIG. 18 shows magnetization curve 61 of thin film magnet 100*a* in in-plane direction D10*a* and magnetization curve 63 of the comparative example of the thin film magnet. In the magnetization curve 61 of thin film magnet 100*a* in in-plane direction D10*a*, the value on the horizontal axis is smaller and the value on the vertical axis is larger than magnetization curve 63 of the comparative example of the thin film magnet. Thus, thin film magnet 100*a* has a small coercive force, but has a high residual flux density and high squareness.

FIG. 19 shows the second quadrants of B-H curve 64 of thin film magnet 100*a* according to Embodiment 4 the comparative example in in-plane direction D10*a* and B-H curve 65 of the comparative example of the thin film magnet including no intermediate layer 32 in in-plane direction D10*a*.

An area surrounded by B-H curve 64 of thin film magnet 100*a* according to Embodiment 4 is larger than an area surrounded by B-H curve 65 of the comparative example of the thin film magnet. Thus, thin film magnet 100*a* has a larger BH product indicating energy of a magnet than in the comparative example of the thin film magnet. This also shows that a maximum energy product, one of important properties of a magnet, of the thin film magnet according to Embodiment 4 is large.

The crystal of $SmCo_5$ constituting magnetic body 30 is a hexagonal crystal, the crystal of $Sm_2Co_{17}$ is a rhombohedral crystal, and magnetic body 30 of thin film magnet 100*a* according to this embodiment is oriented in the (11-20) direction of $Sm_xCo_y$ as a hexagonal crystal or a rhombohedral crystal. Thus, the c axis of the crystal of magnetic body 30 is parallel to in-plane direction D10*a*. Since magnetocrystalline anisotropy of $SmCo_5$ is in the c axis direction, magnetic body 30 has magnetocrystalline anisotropy in in-plane direction D10*a*.

Figure 20:
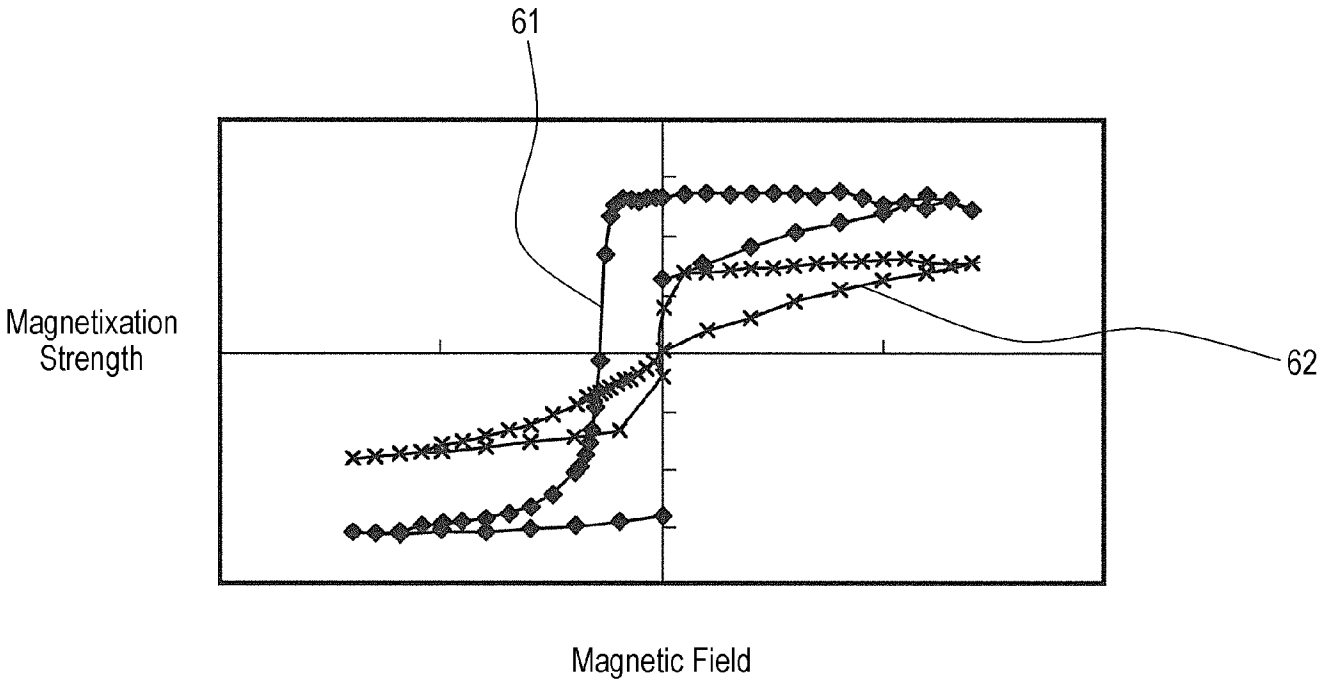
FIG. 20 shows magnetization curves of the thin film magnet according to Embodiment 4.

FIG. 20 shows magnetization curves of thin film magnet 100*a* according to Embodiment 4. Specifically, FIG. 20 shows magnetization curve 61 of thin film magnet 100*a* in in-plane direction D10*a* and magnetization curve 62 in stacking direction D1 perpendicular to in-plane direction D10*a*.

As shown in FIG. 20, in the case of using Co for intermediate layer 32, thin film magnet 100*a* shows larger magnetization in magnetization curve 61 in in-plane direction D10*a* than in magnetization curve 62 in stacking direction D1. Thus, Co oriented in the (110) direction for intermediate layer 32 causes thin film magnet 100*a* to have magnetocrystalline anisotropy in in-plane direction D10*a* and to produce a strong magnetic field in in-plane direction D10*a*.

In the case of using Cu oriented in the (111) direction for intermediate layer 32 instead of Co oriented in the (110) direction, in thin film magnet 100*a* after the heat treatment, magnetic layers 31 and 33 have magnetocrystalline anisotropy in normal direction D10*b* and generate strong magnetic fields in normal direction D10*b*.

As described above, in thin film magnet 100*a* according to Embodiment 4, $Sm_xCo_y$ having a high energy product is used for magnetic layers 31 and 33, Co or Cu is used as intermediate layer 32. Thus, thin film magnet 100*a* has magnetocrystalline anisotropy in predetermined directions, such as in-plane direction D10*a* and normal direction D10*b*, a sufficiently large coercive force, and a high residual flux density.

The c axes of crystalline particles of magnetic body 30 are generally oriented in in-plane direction D10*a*. However, magnetic body 30 according to Embodiment 4 has a polycrystalline structure and includes crystalline dispersion, and thus, it is not intended that the c axes of all the crystalline particles are completely oriented in the same direction. For example, in the case of using Co as intermediate layer 42, magnetic body 30 has magnetic anisotropy in in-plane direction D10*a*. This means that the c axes of crystalline particles in magnetic body 30 are generally oriented in in-plane direction D10*a* and does not mean that the c axes of all the crystalline particles are completely oriented in in-plane direction D10*a*. In magnetic body 30 in accordance with Embodiment 4, the crystal direction is oriented in the c axis direction as a whole. As long as the number of crystalline particles having c axes at angles ranging from 0° to 45° with respect to in-plane direction D10*a* is larger than the number of crystalline particles having c axes at angles ranging from 45° to 90° with respect to in-plane direction D10*a*, similar advantages can be obtained although the degree of the advantages are different.

In accordance with Embodiment 4, magnetic layers 31 and 33 are made of $Sm_xCo_y$, but are not limited to $Sm_xCo_y$. For example, part of Co may be replaced by Fe and Cu to enhance magnetization as a material. In order to increase the effect of replacement between Co and other elements, Zr or other elements may be mixed into magnetic layers 31 and 33 as an additive. In magnetic layers 31 and 33, Co of $Sm_xCo_y$ may be replaced by Fe so that $Sm_2Fe_{14}N_3$ containing N, which is an interstitial material, is obtained. In this case, magnetic layers 31 and 33 may be formed in an atmosphere subjected to nitrogen replacement in crystallization to cause nitrogen to enter. Specifically, an amorphous $Sm_xFe_yN_z$ layer may be formed above substrate 10 by performing low-temperature sputtering of a $Sm_aFe_bN_c$ target in a mixed atmosphere of Ar gas and $N_2$ gas, or an amorphous $Sm_xFe_yN_z$ layer may be formed above substrate 10 by performing low-temperature sputtering on a SmFe target in a mixed atmosphere of Ar gas and $N_2$ gas. After that, the heat treatment is performed in high-purity nitrogen in which replacement is performed after the back pressure of the SmFeN layer formed above substrate 10 is evacuated to a vacuum atmosphere or an extremely high vacuum. This configuration crystallizes $Sm_2Fe_{14}N_3$.

Instead of Co, intermediate layer 32 may use Fe that is a cubic crystal having a (110) plane oriented in parallel with surface 810 of substrate 10. Similarly, instead of Co, CoFe that is a cubic crystal having a (110) plane oriented in parallel with surface 810 of substrate 10 may be used. As intermediate layer 32, Cu may be replaced by Ni having a (111) plane in which crystalline is oriented. As intermediate layer 32, Cu may be replaced by metal particles 32*p* of a hexagonal crystal having a (0001) plane in which crystalline is oriented. As metal particles 32*p* of this hexagonal crystal, Ti, Co, Zr, Mg, or Hf may be used. In particular, Ti is preferable because of a small amount of lattice mismatch. Co as a hexagonal crystal can be obtained by controlling conditions of sputtering.

Oxidation-inhibiting layer 20*a* may include Nb, W, or Mo, instead of Ta. Oxidation-inhibiting layer 20*a* is required to be non-magnetic and have a high melting point. In particular, oxidation-inhibiting layer 20*a* preferably has a melting point higher than or equal to three times as large as a heat treatment temperature at which $SmCo_5$ films of magnetic layers 31 and 33 are crystallized. This configuration effectively suppresses recrystallization of oxidation-inhibiting layer 20*a* in the crystallizing of magnetic layers 31 and 33. Oxidation-inhibiting layer 20*a* includes at least one of Ta, Nb, W, and Mo.

Oxidation-inhibiting layer 20*b* is similar to oxidation-inhibiting layer 20*a*.

Oxidation-inhibiting layers 20*a* and 20*b* do not necessarily be made of the same material, but are made of the same material in accordance with this embodiment from the viewpoint of reduction of materials to be used.

Intermediate layer 32 does not necessarily be continuous in in-plane direction D10*a* of substrate 10, and may partially has island shapes or interrupted. In this case, no problems arise in terms of function. That is, in accordance with this embodiment, the "intermediate layer" includes any layer disposed between magnetic layers including not only a case where the intermediate layer is continuous in in-plane direction D10*a* of substrate 10 but also a case where the intermediate layer has partially an island shape or interrupted. That is, in the magnetic layer, a region where a distribution concentration of metal particles 32*p* is higher than its surrounding portions will be hereinafter referred to as an "intermediate layer."

The presence of intermediate layer 32 is detected by an observation with a transmission electron microscope. In addition to the observation with a transmission electron microscope, a method of measuring the concentration of metal particles 32*p* constituting intermediate layer 32 and determining, as intermediate layer 32, a region where the distribution concentration of metal particles 32*p* is locally higher than its surrounding portions, may be employed.

It was confirmed that similar advantages can be obtained in the case where the thickness of intermediate layer 32 in stacking direction D1 is changes within the range from 1 nm to 30 nm. Observation with a scanning-type transmission electron microscope confirmed a structure in which intermediate layer 32 spreads into magnetic layers 31 and 33 to partially have island shapes. Thus, it can be concluded that the same advantages can be obtained when the thicknesses changes as described above.

Exemplary Embodiment 5

Figure 21:
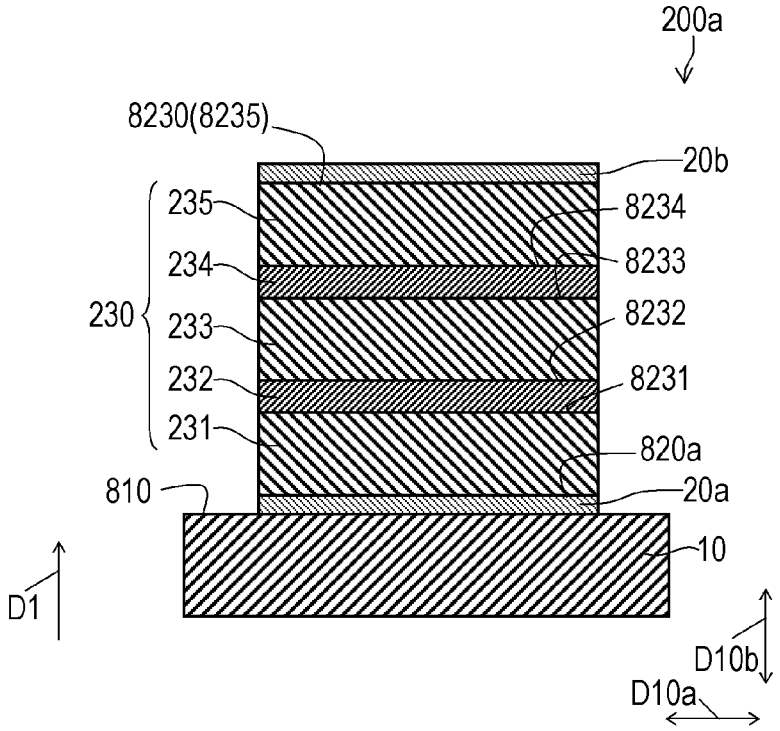
FIG. 21 is a cross-sectional view of a thin film magnet according to Exemplary Embodiment 5.

FIG. 21 is a cross-sectional view of thin film magnet 200*a* according to Exemplary Embodiment 5. In FIG. 21, components identical to those of thin film magnet 100*a* according to Embodiment 4 illustrated in FIG. 9 are denoted by the same reference numerals.

Thin film magnet 200*a* according to Embodiment 5 is different from thin film magnet 100*a* according to Embodiment 4 in the structure of magnetic layers. Thin film magnet 200*a* includes magnetic body 230 provided on upper surface 820*a* of oxidation-inhibiting layer 20*a*, instead of magnetic body 30 of thin film magnet 100*a* illustrated in FIG. 9. Oxidation-inhibiting layer 20*b* is provided on upper surface 8230 of magnetic body 230.

As illustrated in FIG. 21, magnetic body 230 of thin film magnet 200*a* according to Embodiment 5 has a structure in which magnetic layer 231, intermediate layer 232, magnetic layer 233, intermediate layer 234, and magnetic layer 235 are stacked on one another in this order in stacking direction D1. Specifically, magnetic body 230 includes magnetic layer 231 provided on upper surface 820*a* of oxidation-inhibiting layer 20*a*, intermediate layer 232 provided on upper surface 8231 of magnetic layer 231, magnetic layer 233 provided on upper surface 8232 of intermediate layer 232, intermediate layer 234 provided on upper surface 8233 of magnetic layer 233, and magnetic layer 235 provided on upper surface 8234 of intermediate layer 234.

That is, in magnetic body 230 according to Embodiment 5, magnetic layers 231 and 233 correspond to magnetic layers 31 and 33 of magnetic body 30 in accordance with Embodiment 4, respectively. Intermediate layer 232 in accordance with Embodiment 5 corresponds to intermediate layer 32 in accordance with Embodiment 4. In magnetic body 230 according to Embodiment 5, intermediate layer 234 and magnetic layer 235 are stacked on magnetic layer 33 of thin film magnet 100*a* according to Embodiment 4. Magnetic layer 235 has the same composition as magnetic layers 31 and 33, and can be obtained by a manufacturing process similar to that of magnetic layers 31 and 33. Intermediate layer 234 can be obtained by a manufacturing process similar to that of intermediate layer 32.

Thin film magnet 200*a* according to the present embodiment also has the same advantages as those of thin film magnet 100*a* according to Embodiment 4. In addition, since plural intermediate layers 232 and 234 and plural magnetic layers 231, 233, and 235 are stacked, thin film magnet 200*a* reduces continuous growth of particles, thereby improving a coercive force.

Although the foregoing description is directed to thin film magnets according to exemplary embodiments of the present disclosure, the present disclosure is not limited to the embodiments.

For example, in the exemplary embodiment described above, $Sm_xCo_y$ is used as a material constituting magnetic layers 31, 33, 231, 233, and 235, but the materials constituting magnetic layers 31 and 33, 231, 233, and 235 are not limited to these examples, and a material in which part of Co is replaced by Fe and Cu or a material in which Zr or other elements are mixed as an additive. The material may be, e.g. $Sm_2Fe_{14}N_3$.

Oxidation-inhibiting layers 20*a* and 20*b* are not limited to the material containing Ta as described above, and may include Nb, W, or Mo, instead of Ta. The same material may be used for all the oxidation-inhibiting layers 20*a* and 20*b*, or different materials may be used for the oxidation-inhibiting layers.

Oxidation-inhibiting layers 20*a* and 20*b*, magnetic layers 31, 33, 231, 233, and 235, and intermediate layers 32, 232, and 234 may be formed by sputtering as described in the above exemplary embodiment or may be formed by other methods. The heat treatment temperature is not limited to the temperatures described above, and may be changed appropriately depending on materials.

The present disclosure is not limited to the exemplary embodiments. Embodiments in which variations conceivable to those skilled in the art are made on the exemplary embodiments and embodiments using combinations of components of different exemplary embodiments may be included within the range of one or more aspect, as long as these embodiments are within the gist of the present disclosure.

As described above, thin film magnet 100*a* (200*a*) includes substrate 10, oxidation-inhibiting layer 20*a* in an amorphous state provided on upper surface 810 of the substrate, magnetic material layer 31 (231) provided on oxidation-inhibiting layer 20*a*, intermediate layer 32 (232) provided on magnetic layer 31 (231), magnetic layer 33 (233) provided on intermediate layer 32 (232), and oxidation-inhibiting layer 20*b* in an amorphous state provided above magnetic layer 33 (233). Intermediate layer 32 includes metal particles 32*p*. Metal particles 32*p* are diffused in magnetic layers 31 and 33 (231 and 233). The concentration of metal particles 32*p* at a part of magnetic layers 31 (231) decreases as the distance from intermediate layer 32 (232) to the part of magnetic layers 31 (231) increases. The concentration of metal particles 32*p* at a part of magnetic layers 33 (233) decreases as the distance from intermediate layer 32 (232) to the part of magnetic layers 33 (233) increases.

This configuration provides thin film magnet 100*a* (200*a*) with magnetic anisotropy in a predetermined direction, for example, in-plane direction D10*a* or normal direction D10*b*, a high energy product, a sufficiently large coercive force, and a high residual flux density.

Magnetic layers 31 and 33 (231 and 233) may have magnetocrystalline anisotropy in in-plane direction D10*a* parallel to upper surface 810 of substrate 10.

With this configuration, magnetic layers 31 and 33 (231 and 233) are formed such that magnetic layers 31 and 33 (231 and 233) are oriented in-plane direction D10*a*. Thin film magnet 100*a* having magnetic anisotropy in in-plane direction D10*a* can thus be obtained.

Intermediate layer 32 (232) may be constituted by a crystal having a cubic crystal structure oriented in the (110) direction or by a crystal having a hexagonal crystal oriented in the (11-20) direction.

This configuration allows orientations of magnetic layers 31 and 33 (231 and 233) to be easily controlled in in-plane direction D10*a* in accordance with orientation of intermediate layer 32 (232).

Intermediate layer 32 (232) may contain at least one of cobalt (Co) and iron (Fe).

With this configuration, Co for intermediate layers 32 (232) allows orientations of magnetic layers 31 and 33 (231 and 233) to be easily controlled in in-plane direction D10*a*.

Magnetic layers 31 and 33 (231 and 233) may have magnetocrystalline anisotropy in normal direction D10*b* perpendicular to upper surface 810 of substrate 10.

With this configuration, magnetic layers 31 and 33 (231 and 233) are formed such that magnetic layers 31 and 33 (231 and 233) are oriented in normal direction D10*b*. Thin film magnet 100*a* (200*a*) having magnetic anisotropy in normal direction D10*b* can thus be obtained.

Intermediate layer 32 (232) may be constituted by a crystal having a cubic crystal structure oriented in the (111) direction.

This configuration allows orientations of magnetic layers 31 and 33 (231 and 233) to be easily controlled in normal direction D10*b* in accordance with orientation of intermediate layer 32 (232).

Intermediate layer 32 (232) may contain copper (Cu).

With this configuration, Cu for intermediate layers 32 (232) allows orientations of magnetic layers 31 and 33 (231 and 233) to be easily controlled in normal direction D10*b*.

Intermediate layer 32 (232) may be constituted by a crystal having a hexagonal crystal structure oriented in the (0001) direction.

This configuration allows orientations of magnetic layers 31 and 33 (231 and 233) to be easily controlled in normal direction D10*b* in accordance with orientation of intermediate layer 32 (232).

Intermediate layer 32 (232) may contain titanium (Ti) or zirconium (Zr).

With this configuration, Ti or Zr for intermediate layers 32 (232) allows orientations of magnetic layers 31 and 33 (231 and 233) to be easily controlled in normal direction D10*b*.

Intermediate layer 32 (232) may have lower crystallization temperature than magnetic layers 31 and 33 (231 and 233).

With this configuration, even when intermediate layer 32 (232) is crystallized, magnetic layer 31 (231) can be maintained in an amorphous state.

Magnetic layers 31 and 33 (231 and 233) may contain samarium (Sm).

With this configuration, a material, such as $Sm_xCo_y$, containing Co and at least one of Sm, Pr, Nd, Y, La, and Gd for magnetic layers 31 and 33 (231 and 233) provides thin film magnet 100*a* (200*a*) with a high energy product.

Each of oxidation-inhibiting layers 20*a* and 20*b* may contain at least one of tantalum (Ta), niobium (Nb), tungsten (W), and molybdenum (Mo).

This configuration provides oxidation-inhibiting layers 20*a* and 20*b* with high oxidation suppressing function.

Thin film magnet 200*a* may further include magnetic layer 234 provided on magnetic layer 233 and magnetic layer 235 provided on intermediate layer 234. Intermediate layer 234 includes metal particles 234*p*. Metal particles 234*p* are diffused in magnetic layers 233 and 235. The concentration of metal particles 234*p* in a part of magnetic layer 233 decreases as the distance from intermediate layer 234 to the part of magnetic layer 233 increases. The concentration of metal particles 234*p* in a part of magnetic layer 235 decreases as the distance from intermediate layer 234 to the part of magnetic layer 235 increases.

Magnetic layer 235 may have magnetocrystalline anisotropy in in-plane direction D10*a* parallel to upper surface 810 of substrate 10.

Intermediate layer 234 may be constituted by a crystal having a cubic crystal structure oriented in the (110) direction or by a crystal having a hexagonal crystal oriented in the (11-20) direction.

Intermediate layer 234 may contain at least one of cobalt (Co) and iron (Fe).

Magnetic layer 235 may have magnetocrystalline anisotropy in normal direction D10*b* perpendicular to upper surface 810 of substrate 10.

Intermediate layer 234 may be constituted by a crystal having a cubic crystal structure oriented in the (111) direction.

Intermediate layer 234 may contain copper (Cu).

Intermediate layer 234 may be constituted by a crystal having a hexagonal crystal structure oriented in the (0001) direction.

Intermediate layer 234 may contain titanium (Ti) or ruthenium (Zr).

Each of intermediate layers 232 and 234 may have a crystallization temperature lower than those of magnetic layers 231, 233, and 235.

Each of magnetic layers 231, 233, and 235 may be made of a material containing Co and at least one of Sm, Pr, Nd, Y, La, and Gd.

Thin film magnet 100*a* (200*a*) can be manufactured by the following method. Oxidation-inhibiting layer 20*a* in an amorphous state is formed on upper surface 810 of substrate 10. Magnetic layer 31 (231) is formed on oxidation-inhibiting layer 20*a*. Intermediate layer 32 including metal particles 32*p* is formed on magnetic layer 31 (231). Intermediate layer 33 (233) is formed on magnetic layer 32. Oxidation-inhibiting layer 20*b* in an amorphous state is formed above magnetic layer 33 (233). A heat treatment is performed on oxidation-inhibiting layers 20*a* and 20*b*, magnetic layers 31 and 33 (231 and 233), and intermediate layer 32.

This configuration provides thin film magnet 100*a* (200*a*) having magnetic anisotropy in a predetermined direction, for example, in-plane direction D10*a* or normal direction D10*b*, a high energy product, a sufficiently large coercive force, and a high residual flux density.

In the process for forming magnetic layers 31 and 33 (231 and 233), magnetic layers 31 and 33 (231 and 233) may be formed in an amorphous state. In the process of forming intermediate layer 32 (232), intermediate layer 32 (232) may be formed by crystallization. In the heat treatment, magnetic layers 31 and 33 (231 and 233) may be crystallized.

This configuration allows orientations of magnetic layers 31 and 33 (231 and 233) to be easily controlled in accordance with orientation of intermediate layer 32 (232).

In the process of forming magnetic layers 31 and 33 (231 and 233), magnetic layers 31 and 33 (231 and 233) may be made of a material containing Co and at least one of Sm, Pr, Nd, Y, La, and Gd.

With this configuration, a material, such as $Sm_xCo_y$, containing Sm for magnetic layers 31 and 33 (231 and 233) provides thin film magnet 100*a* (200*a*) with a high energy product to be obtained.

In the process of forming magnetic layers 31 and 33 (231 and 233), magnetic layers 31 and 33 (231 and 233) may be formed in an amorphous state with the surface temperature of substrate 10 equal to or lower than 400° C. In the process for forming intermediate layer 32 (232), magnetic layer 32 (232) may be formed at the surface temperature of substrate 10 equal to or lower than 400° C. The heat treatment may be performed on oxidation-inhibiting layers 20*a* and 20*b*, magnetic layers 31 and 33 (231 and 233), and intermediate layers 32 (232) at the surface temperature of substrate 10 equal to or higher than 500° C.

With this configuration, in the forming of intermediate layer 32 (232), intermediate layer 32 (232) can be crystallized while magnetic layer 31 (231) can be in an amorphous state. This configuration allows orientations of magnetic layers 31 and 33 (231 and 233) to be easily controlled in accordance with orientation of intermediate layer 32 (232).

In the process for forming oxidation-inhibiting layers 20*a* and 20*b*, oxidation-inhibiting layers 20*a* and 20*b* may be made of material containing at least one of Ta, Nb, W, and Mo.

This configuration provides oxidation-inhibiting layers 20*a* and 20*b* with high oxidation suppressing function.

In the foregoing exemplary embodiments, terms, such as "upper surface," "above," and "below," indicating directions indicate relative directions determined based on relative positional relationships among components of a thin film magnet, and do not indicate absolute directions, such as a vertical direction.

INDUSTRIAL APPLICABILITY

A thin film magnet according to the present invention is useful as, for example, a permanent magnet required to have a high energy product, such as a sensor, an actuator, or a motor.

REFERENCE MARKS IN THE DRAWINGS

10 substrate
20*a*, 320*a*, 420*a* oxidation-inhibiting layer (first oxidation-inhibiting layer)
20*b*, 320*b*, 420*b* oxidation-inhibiting layer (second oxidation-inhibiting layer)
20*c*, 320*c* oxidation-inhibiting layer (third oxidation-inhibiting layer)
30, 230, 330 magnetic body (first magnetic body)
31, 231, 331, 431 magnetic layer (first magnetic layer)
32, 232, 332, 432 intermediate layer (first intermediate layer)
32*p* metal particles (first metal particles)
33, 233, 333, 433 magnetic layer (second magnetic layer)
40, 340 magnetic body (second magnetic body)
41, 341 magnetic layer (third magnetic layer)
42, 342, 442 intermediate layer (second intermediate layer)
42*p*, 342*p* metal particles (second metal particles)
43, 343 magnetic layer (fourth magnetic layer)
100, 100*a*, 200, 200*a*, 300 thin film magnet
235 magnetic layer (third magnetic layer)
300*a* thin film magnet
300*b* thin film magnet
320*d* oxidation-inhibiting layer
380 hole
P300 boundary portion

The invention claimed is:

1. A thin film magnet comprising:

a substrate;

a first oxidation-inhibiting layer in an amorphous state disposed on an upper surface of the substrate;

a first magnetic layer disposed on the first oxidation-inhibiting layer;

a first intermediate layer disposed on the first magnetic layer, the first intermediate layer containing first metal particles;

a second magnetic layer disposed on the first intermediate layer; and a second oxidation-inhibiting layer in an amorphous state disposed above the second magnetic layer, wherein the first metal particles are diffused in a part of the first magnetic layer and the second magnetic layer, a concentration of the first metal particles in a part of the first magnetic layer decrease as a distance from the first intermediate layer to the part of the first magnetic layer increases, and a concentration of the first metal particles in a part of the second magnetic layer decrease as a distance from the first intermediate layer to the part of the second magnetic layer increases.

2. The thin film magnet of claim 1, wherein each of the first magnetic layer and the second magnetic layer has magnetocrystalline anisotropy in an in-plane direction parallel to the upper surface of the substrate.

3. The thin film magnet of claim 2, wherein the first intermediate layer is constituted by a crystal with a cubic crystal structure oriented in a (110) direction or a crystal with a hexagonal crystal structure oriented in a (11-20) direction.

4. The thin film magnet of claim 3, wherein the first intermediate layer contains at least one of cobalt (Co) and iron (Fe).

5. The thin film magnet of claim 1, wherein each of the first magnetic layer and the second magnetic layer has magnetocrystalline anisotropy in a normal direction perpendicular to the upper surface of the substrate.

6. The thin film magnet of claim 5, wherein the first intermediate layer is constituted by a crystal with a cubic crystal structure oriented in a (111) direction.

7. The thin film magnet of claim 6, wherein the first intermediate layer contains copper (Cu).

8. The thin film magnet of claim 5, wherein the first intermediate layer is constituted by a crystal with a hexagonal crystal structure oriented in a (0001) direction.

9. The thin film magnet of claim 8, wherein the first intermediate layer contains titanium (Ti) or zirconium (Zr).

10. The thin film magnet of claim 1, further comprising:

a second intermediate layer disposed on the second magnetic layer, the second intermediate layer containing second metal particles; and a third magnetic layer disposed on the second intermediate layer, wherein the second metal particles are diffused in the second magnetic layer and the third magnetic layer, a concentration of the second metal particles in a part of the second magnetic layer decreases as a distance from the second intermediate layer to the part of the second magnetic layer increases, and a concentration of the second metal particles in a part of the third magnetic layer decreases as a distance from the second intermediate layer to the part of the third magnetic layer increases.

11. The thin film magnet of claim 10, wherein each of the first magnetic layer, the second magnetic layer, and the third magnetic layer has magnetocrystalline anisotropy in an in-plane direction parallel to the upper surface of the substrate.

12. The thin film magnet of claim 11, wherein the first intermediate layer is constituted by a crystal with a cubic crystal structure oriented in a (110) direction or a crystal with a hexagonal crystal structure oriented in a (11-20) direction, and the second intermediate layer is constituted by a crystal with a cubic crystal structure oriented in a (110) direction or a crystal with a hexagonal crystal structure oriented in a (11-20) direction.

13. The thin film magnet of claim 12, wherein the first intermediate layer contains at least one of cobalt (Co) and iron (Fe), and the second intermediate layer contains at least one of cobalt (Co) and iron (Fe).

14. The thin film magnet of claim 10, wherein each of the first magnetic layer, the second magnetic layer, and the third magnetic layer has magnetocrystalline anisotropy in a normal direction perpendicular to the upper surface of the substrate.

15. The thin film magnet of claim 14, wherein the first intermediate layer is constituted by a crystal with a cubic crystal structure oriented in a (111) direction, and the second intermediate layer is constituted by a crystal with a cubic crystal structure oriented in a (111) direction.

16. The thin film magnet of claim 15, wherein each of the first intermediate layer and the second intermediate layer contains copper (Cu).

17. The thin film magnet of claim 14, wherein the first intermediate layer is constituted by a crystal with a hexagonal crystal structure oriented in a (0001) direction, and the second intermediate layer is constituted by a crystal with a hexagonal crystal structure oriented in a (0001) direction.

18. The thin film magnet of claim 17, wherein the first intermediate layer contains titanium (Ti) or zirconium (Zr), and the second intermediate layer contains titanium (Ti) or zirconium (Zr).

19. A method for manufacturing a thin film magnet, the method comprising:

forming a first oxidation-inhibiting layer in an amorphous state on an upper surface of a substrate;

forming a first magnetic layer on the first oxidation-inhibiting layer;

forming an intermediate layer on the first magnetic layer, the intermediate layer containing metal particles;

forming a second magnetic layer on the intermediate layer;

forming a second oxidation-inhibiting layer in an amorphous state above the second magnetic layer; and performing heat treatment to the first oxidation-inhibiting layer, the first magnetic layer, the intermediate layer, the second magnetic layer, and the second oxidation-inhibiting layer, wherein the first metal particles are diffused in a part of the first magnetic layer and the second magnetic layer, a concentration of the first metal particles in a part of the first magnetic layer decrease as a distance from the first intermediate layer to the part of the first magnetic layer increases, and a concentration of the first metal particles in a part of the second magnetic layer decrease as a distance from the first intermediate layer to the part of the second magnetic layer increases.

20. The method of claim 19, wherein the first magnetic layer is in an amorphous state in said forming the first magnetic layer, the second magnetic layer is in an amorphous state in said forming the second magnetic layer, said forming the intermediate layer comprises forming the intermediate layer by crystallization, and said performing the heat treatment comprises performing the heat treatment so as to crystallize the first magnetic layer and the second magnetic layer.

21. The method of claim 19, wherein said forming the first magnetic layer comprises forming the first magnetic layer while a surface temperature of the substrate is equal to or lower than 400° C., said forming the second magnetic layer comprises forming the second magnetic layer while a surface temperature of the substrate is equal to or lower than 400° C., said forming the intermediate layer comprises forming the intermediate layer while a surface temperature of the substrate is equal to or lower than 400° C., and said performing the heat treatment comprises performing the heat treatment to the first oxidation-inhibiting layer, the first magnetic layer, the intermediate layer, the second magnetic layer, and the second oxidation-inhibiting layer while a surface temperature of the substrate is equal to or higher than 500° C.

* * * * *